US009599953B2

(12) United States Patent
Fukamachi

(10) Patent No.: US 9,599,953 B2
(45) Date of Patent: Mar. 21, 2017

(54) CARTRIDGE

(71) Applicant: Brother Kogyo Kabushiki Kaisha, Nagoya-shi, Aichi-ken (JP)

(72) Inventor: Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,516

(22) Filed: Mar. 27, 2015

(65) Prior Publication Data

US 2015/0277354 A1 Oct. 1, 2015

(30) Foreign Application Priority Data

Mar. 31, 2014 (JP) ..... 2014-074726

(51) Int. Cl.

| | |
|---|---|
| ***G03G 21/16*** | (2006.01) |
| ***G03G 21/18*** | (2006.01) |
| ***G03G 15/00*** | (2006.01) |
| ***G03G 15/08*** | (2006.01) |

(52) U.S. Cl.

CPC ..... *G03G 21/1647* (2013.01); *G03G 15/0865* (2013.01); *G03G 15/757* (2013.01); *G03G 21/1857* (2013.01); *G03G 21/1896* (2013.01)

(58) Field of Classification Search

CPC ..... G06G 15/757; G06G 21/1857; G06G 21/1647; G06G 15/0865

See application file for complete search history.

(56) References Cited

U.S. PATENT DOCUMENTS

| | | | |
|---|---|---|---|
| 4,974,020 | A | 11/1990 | Takamatsu et al. |
| 5,053,816 | A | 10/1991 | Takahashi |
| 5,489,976 | A | 2/1996 | Ichikawa |
| 5,495,323 | A | 2/1996 | Meetze, Jr. |
| 5,495,327 | A | 2/1996 | Inomata |
| 5,640,651 | A | 6/1997 | Katoh et al. |

(Continued)

FOREIGN PATENT DOCUMENTS

| | | | |
|---|---|---|---|
| AU | 2010281279 | B2 | 2/2014 |
| CN | 1445624 | A | 10/2003 |

(Continued)

OTHER PUBLICATIONS

Feb. 27, 2014—(KR) Notice of Preliminary Rejection—App 10-2012-7028457.

(Continued)

*Primary Examiner* — Rodney Bonnette

(74) *Attorney, Agent, or Firm* — Banner & Witcoff, Ltd.

(57) ABSTRACT

A cartridge including a housing, a driving receiving part, a rotary member configured to rotate, and move in an axis direction thereof while rotating, and a detected member configured to move in the axis direction by receiving a driving force from the rotary member, wherein the rotary member includes a main body part having a first surface facing the detected member in the axis direction and a second surface positioned at an opposite side of the first surface in the axis direction, an operating part arranged on the first surface and configured to apply a force for moving the detected member in the axis direction to the detected member, and an operated part arranged on the second surface and configured to receive a force for moving the main body part in the axis direction.

12 Claims, 18 Drawing Sheets

(56) References Cited

U.S. PATENT DOCUMENTS 5,649,264 A 7/1997 Domon et al.
5,970,293 A 10/1999 Huang
6,088,561 A 7/2000 Kawamura et al.
6,154,619 A 11/2000 Boockholdt et al.
6,714,224 B2 3/2004 Yamanaka et al.
6,792,217 B2 9/2004 Nishino et al.
6,823,160 B2 11/2004 Okabe
6,829,465 B2 12/2004 Yamanaka et al.
6,903,759 B2 6/2005 Yamanaka et al.
6,909,866 B2 6/2005 Kawai
6,920,303 B2 7/2005 Yamanaka et al.
7,116,919 B2 10/2006 Ishii
7,130,551 B2 10/2006 Kobayashi
7,418,214 B2 8/2008 Yoshida et al.
7,463,834 B2 12/2008 Takagi et al.
7,509,075 B2 3/2009 Hayakawa
7,512,347 B2 3/2009 Suzuki et al.
7,536,117 B2 5/2009 Kishi
7,613,414 B2 11/2009 Kamimura
7,643,777 B2 1/2010 Matsumoto et al.
7,756,426 B2 7/2010 Kamimura
7,933,536 B2 4/2011 Ogawa
7,953,330 B2 5/2011 Ishikawa
8,010,026 B2 8/2011 Kobayashi et al.
RE42,796 E 10/2011 Ishii
8,090,272 B2 1/2012 Ishikawa
8,099,025 B2 1/2012 Ishikake
8,126,366 B2 2/2012 Hattori
8,417,130 B2 4/2013 Hashimoto
8,463,145 B2 * 6/2013 Ukai ..... G03G 21/1896 399/111
8,583,009 B2 11/2013 Takagi
8,600,244 B2 12/2013 Hashimoto
8,620,180 B2 12/2013 Shiraki et al.
8,666,293 B2 3/2014 Mushika et al.
8,744,288 B2 6/2014 Shinoya et al.
8,761,643 B2 * 6/2014 Mushika ..... G03G 15/0863 399/120
8,849,133 B2 9/2014 Itabashi et al.
8,867,932 B2 * 10/2014 Ukai ..... G03G 21/1896 399/111
8,948,617 B2 2/2015 Shiraki et al.
8,948,661 B2 2/2015 Mushika et al.
9,195,207 B2 11/2015 Itabashi
9,207,567 B2 12/2015 Mushika et al.
2003/0185579 A1 10/2003 Nishino et al.
2003/0185594 A1 10/2003 Okabe
2003/0215265 A1 11/2003 Kawai
2006/0034625 A1 2/2006 Kajikawa
2006/0104670 A1 5/2006 Nishitani et al.
2006/0165423 A1 7/2006 Nishitani et al.
2006/0171737 A1 8/2006 Nishimura et al.
2006/0193643 A1 8/2006 Takagi et al.
2006/0193646 A1 8/2006 Suzuki et al.
2006/0245787 A1 11/2006 Ito et al.
2007/0031158 A1 2/2007 Kamimura
2007/0041747 A1 2/2007 Kim et al.
2007/0059018 A1 3/2007 Tokuda
2007/0059038 A1 3/2007 Shiraki
2007/0077101 A1 4/2007 Tamura et al.
2007/0122165 A1 5/2007 Igarashi et al.
2007/0140709 A1 6/2007 Yoshida et al.
2007/0140725 A1 6/2007 Kamimura
2007/0253748 A1 11/2007 Matsumoto et al.
2008/0080904 A1 4/2008 Murayama et al.
2008/0205911 A1 8/2008 Ishikawa et al.
2008/0205928 A1 8/2008 Ishikawa
2008/0205931 A1 8/2008 Ishikawa
2008/0223173 A1 9/2008 Ishikawa
2008/0317509 A1 12/2008 Mori
2009/0000423 A1 1/2009 Ishikawa et al.
2009/0052911 A1 2/2009 Richey et al.
2009/0084210 A1 4/2009 Tsukada et al.
2009/0169247 A1 7/2009 Hattori
2009/0257782 A1 10/2009 Ishikake
2009/0269085 A1 10/2009 Ukai
2009/0269086 A1 10/2009 Mikuni
2009/0285604 A1 11/2009 Nakajima
2009/0297226 A1 12/2009 Nagashima et al.
2010/0054763 A1 3/2010 Tomiyori et al.
2010/0209144 A1 8/2010 Nieda
2011/0023368 A1 2/2011 Mizutani et al.
2011/0038649 A1 2/2011 Miyabe et al.
2011/0081163 A1 4/2011 Lee
2011/0123231 A1 5/2011 Ozawa et al.
2011/0236062 A1 9/2011 Takagi
2011/0236065 A1 9/2011 Takagi
2011/0236066 A1 9/2011 Takagi
2011/0243578 A1 10/2011 Ukai et al.
2012/0014713 A1 1/2012 Murakami et al.
2012/0051795 A1 3/2012 Mushika et al.
2012/0057905 A1 3/2012 Itabashi
2012/0134688 A1 5/2012 Hashimoto
2012/0148297 A1 6/2012 Peng et al.
2012/0177398 A1 7/2012 Takigawa
2012/0243882 A1 9/2012 Carot
2012/0251165 A1 10/2012 Mushika et al.
2012/0251216 A1 10/2012 Mushika
2012/0321345 A1 12/2012 Shinoya et al.
2013/0051813 A1 2/2013 Itabashi et al.
2013/0051814 A1 2/2013 Itabashi et al.
2013/0051815 A1 2/2013 Itabashi et al.
2013/0051816 A1 2/2013 Itabashi
2013/0051833 A1 2/2013 Itabashi et al.
2013/0084083 A1 4/2013 Itabashi et al.
2013/0136460 A1 5/2013 Shiraki et al.
2013/0170844 A1 7/2013 Itabashi
2013/0170845 A1 7/2013 Itabashi
2013/0259528 A1 10/2013 Yamamoto
2013/0272724 A1 10/2013 Ukai et al.
2014/0020489 A1 1/2014 Nozaki et al.
2014/0086638 A1 3/2014 Sato
2014/0169835 A1 6/2014 Nakajima
2014/0219690 A1 8/2014 Li et al.
2014/0294403 A1 10/2014 Shimizu
2014/0341617 A1 * 11/2014 Mushika ..... G03G 15/0863 399/260
2014/0363189 A1 12/2014 Hashimoto et al.
2014/0376968 A1 12/2014 Yamamoto et al.
2015/0000443 A1 1/2015 Shimizu
2015/0003844 A1 * 1/2015 Ukai ..... G03G 21/1896 399/12
2015/0005134 A1 1/2015 Shimizu
2015/0010334 A1 1/2015 Nakajima
2015/0037071 A1 2/2015 Yamamoto
2015/0043944 A1 2/2015 Yamamoto
2015/0104222 A1 * 4/2015 Mushika ..... G03G 15/0863 399/279
2015/0117873 A1 4/2015 Mori et al.
2015/0117906 A1 4/2015 Mori
2015/0153675 A1 6/2015 Itabashi et al.

FOREIGN PATENT DOCUMENTS

CN 1828447 A 9/2006
CN 1288515 C 12/2006
CN 2884266 Y 3/2007
CN 1983078 A 6/2007
CN 101063855 A 10/2007
CN 200962188 Y 10/2007
CN 101256379 A 9/2008
CN 101295157 A 10/2008
CN 201170840 Y 12/2008
CN 100476636 C 4/2009
CN 201222170 Y 4/2009
CN 101625537 B 1/2010
CN 201402371 Y 2/2010
CN 201464807 U 5/2010
CN 201489284 U 5/2010
CN 202102251 U 1/2012
CN 202472249 U 10/2012
CN 102799090 A 11/2012
CN 202649679 U 1/2013
CN 203673223 U 6/2014

(56) References Cited

FOREIGN PATENT DOCUMENTS

| | | | |
|---|---|---|---|
| EP | 0838733 | A2 | 4/1998 |
| EP | 1696278 | A2 | 8/2006 |
| EP | 1696278 | A3 | 8/2006 |
| EP | 1965268 | A1 | 9/2008 |
| EP | 1965274 | A2 | 9/2008 |
| EP | 1995644 | A2 | 11/2008 |
| EP | 2093619 | A1 | 8/2009 |
| EP | 2369422 | A1 | 9/2011 |
| EP | 2378378 | A2 | 10/2011 |
| EP | 2463723 | A1 | 6/2012 |
| EP | 2463723 | A4 | 6/2012 |
| EP | 2574991 | A2 | 4/2013 |
| EP | 2574992 | A2 | 4/2013 |
| EP | 2574993 | A2 | 4/2013 |
| HK | 1090991 | A1 | 11/2009 |
| JP | S5323696 | | 2/1978 |
| JP | S6183570 | A | 4/1986 |
| JP | S63-118042 | U | 7/1988 |
| JP | H01205175 | A | 8/1989 |
| JP | H02-78949 | U | 6/1990 |
| JP | H02-262168 | A | 10/1990 |
| JP | H03-212656 | A | 9/1991 |
| JP | H04-31156 | A | 2/1992 |
| JP | H04-31156 | U | 3/1992 |
| JP | H04-191773 | A | 7/1992 |
| JP | H04-112263 | U | 9/1992 |
| JP | H04-114057 | U | 10/1992 |
| JP | 5323696 | B2 | 12/1993 |
| JP | 06-208301 | A | 7/1994 |
| JP | H07-140776 | A | 6/1995 |
| JP | H07-281519 | | 10/1995 |
| JP | H08-179608 | A | 7/1996 |
| JP | H08-248838 | A | 9/1996 |
| JP | H09160466 | A | 6/1997 |
| JP | H09222783 | A | 8/1997 |
| JP | 2551714 | Y2 | 10/1997 |
| JP | H09-258634 | A | 10/1997 |
| JP | H10-301382 | A | 11/1998 |
| JP | H11-37169 | A | 2/1999 |
| JP | H11-52716 | A | 2/1999 |
| JP | 2000338760 | A | 12/2000 |
| JP | 2001-042585 | A | 2/2001 |
| JP | 2001-166648 | A | 6/2001 |
| JP | 3266779 | B2 | 3/2002 |
| JP | 2002-169449 | A | 6/2002 |
| JP | 2003-271039 | A | 9/2003 |
| JP | 2003295614 | A | 10/2003 |
| JP | 2003-337504 | A | 11/2003 |
| JP | 2004-045603 | B2 | 2/2004 |
| JP | 2005-241942 | A | 9/2005 |
| JP | 3710375 | B2 | 10/2005 |
| JP | 2006-235236 | A | 9/2006 |
| JP | 2006-243072 | A | 9/2006 |
| JP | 2006-267994 | A | 10/2006 |
| JP | 2007-079284 | A | 3/2007 |
| JP | 2007-164095 | A | 6/2007 |
| JP | 2007-199514 | A | 8/2007 |
| JP | 2008-089731 | A | 4/2008 |
| JP | 2008-216391 | A | 9/2008 |
| JP | 2008-216392 | A | 9/2008 |
| JP | 2008-216393 | A | 9/2008 |
| JP | 2008-216394 | A | 9/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009069177 | A | 4/2009 |
| JP | 2009-162915 | A | 7/2009 |
| JP | 2009-180983 | A | 8/2009 |
| JP | 4310703 | B2 | 8/2009 |
| JP | 2009-223017 | A | 10/2009 |
| JP | 2009-244560 | A | 10/2009 |
| JP | 2009244563 | A | 10/2009 |
| JP | 2009-276727 | A | 11/2009 |
| JP | 4372703 | B2 | 11/2009 |
| JP | 2009-282099 | A | 12/2009 |
| JP | 2009-288549 | A | 12/2009 |
| JP | 4376861 | B2 | 12/2009 |
| JP | 2011-013323 | A | 1/2011 |
| JP | 3167011 | U | 3/2011 |
| JP | 2011-215374 | A | 10/2011 |
| JP | 4859139 | B2 | 1/2012 |
| JP | 2012-053095 | A | 3/2012 |
| JP | 2012-108537 | A | 6/2012 |
| JP | 2012-194318 | A | 10/2012 |
| JP | 2012-212086 | A | 11/2012 |
| JP | 2012-233941 | A | 11/2012 |
| JP | 2013-011911 | A | 1/2013 |
| JP | 2013501253 | A | 1/2013 |
| JP | 2013054063 | A | 3/2013 |
| RU | 2011138921 | A | 9/2013 |
| WO | 2007062588 | A1 | 6/2007 |
| WO | 2011/015051 | A1 | 2/2011 |
| WO | 2013040989 | A1 | 3/2013 |
| WO | 2013073134 | A1 | 5/2013 |

OTHER PUBLICATIONS

Machine translation of JP 2006-235236 dated Jan. 9, 2014.
Jan. 5, 2012—(JP) Decision of Patent Grant—App 2010-083408.
Apr. 26, 2011 (WO)—International Search Report (JPO)—App PCT/JP2011/057946.
Nov. 12, 2014—(US) Non-Final Office Action—U.S. Appl. No. 14/485,462.
Dec. 31, 2014—(CN) Notification of First Office Action—App 201310175410.5, Eng Tran.
Mar. 20, 2015—(US) Final Office Action—U.S. Appl. No. 154/485,462.
Mar. 27, 2015—(US) Co-pending U.S. Appl. No. 14/670,502.
Mar. 27, 2015—(US) Co-pending U.S. Appl. No. 14/670,676.
Decision to Grant a Patent issued in corresponding Japanese Patent Application No. 2010-193204 dated Sep. 18, 2012.
Notice of Reasons for Rejection issued in Japanese Patent Application No. 2012-229560 mailed Feb. 19, 2013.
Machine translation of JP 07-281519A dated May 2, 2013.
Machine translation of JP 10-031382A dated May 1, 2013.
Notice of Allowance received in U.S. Appl. No. 13/222,096 mailed Oct. 16, 2013.
Office Action received in related Chinese Patent Application No. 201110251898.6 mailed Oct. 15, 2013.
Notification of the First Office Action with Search Report issued in corresponding Chinese Patent Application No. 201110251898.6 dated Dec. 11, 2012.
Notice of Reasons for Rejection issued in corresponding Japanese Patent Application 2010-193204 mailed Jun. 26, 2012.
Notice of Allowance issued in corresponding U.S. Appl. No. 14/154,521 mailed Feb. 10, 2014.
Sep. 19, 2014—(US) Notice of Allowance—U.S. Appl. No. 14/275,251.
Mar. 19, 2015—(US) Non-Final Office Action—U.S. Appl. No. 14/577,396.
Co-pending U.S. Appl. No. 14/316,959, filed Jun. 27, 2014.
Co-pending U.S. Appl. No. 147/316,971, filed Jun. 27, 2014.
Apr. 6, 2015—(US) Non-Final Office Action—U.S. Appl. No. 14/316,959.
Apr. 21, 2015—(EP) Extended Search Report—App 14173865.8.
May 8, 2015—Ex Parte Quayle—U.S. Appl. No. 14/316,971.
May 8, 2015—(US) Ex Parte Quayle—U.S. Appl. No. 14/316,971.
Mar. 3, 2015—(CN) Notification of First Office Action—App 201310175264.6, Eng Tran.
Mar. 3, 2015—(CN) Notification of First Office Action—App 201310175229.4, Eng Tran.
Apr. 14, 2014—(US) Non-Final Office Action—U.S. Appl. No. 13/628,492.
Sep. 23, 2014—(US) Notice of Allowance—U.S. Appl. No. 13/628,492.
Apr. 15, 2015—(US) Notice of Allowance—U.S. Appl. No. 14/529,221.

(56) References Cited

OTHER PUBLICATIONS

Aug. 4, 2015—(US) Notice of Allowance—U.S. Appl. No. 14/577,396.
Aug. 20, 2015—(EP) Extended EP Search Report in App No. 15161221.5.
Aug. 21, 2015—(EP) Extended Search Report—App 15161258.7.
Aug. 25, 2015—(US) Non-Final Office Action—U.S. Appl. No. 14/671,413.
Jul. 22, 2015—(US) Non-Final Office Action—U.S. Appl. No. 14/316,971.
May 18, 2015—(US) Non-Final Office Action—U.S. Appl. No. 14/611,393.
Oct. 5, 2015—(US) Non-Final Office Action—U.S. Appl. No. 14/670,801.
Oct. 19, 2015—(US)—Non-Final Office Action—U.S. Appl. No. 14/611,393.
Sep. 16, 2015—(US) Notice of Allowance—U.S. Appl. No. 14/485,462.
Sep. 17, 2015—(EP) Office Action—App 11179283.4.
Sep. 17, 2015—(EP) Office Action—App 11160291.8.
Sep. 17, 2015—(US) Non-Final Office Action—U.S. Appl. No. 14/670,489.
Sep. 23, 2015—(US) Notice of Allowance—U.S. Appl. No. 14/529,221.
Sep. 30, 2015—(US) Non-Final Office Action—U.S. Appl. No. 14/670,522.
Oct. 28, 2015—(US) Notice of Allowance—U.S. Appl. No. 14/316,959.
Nov. 27, 2015—(US) Non-Final Office Action—U.S. Appl. No. 14/670,502.
Dec. 14, 2015—(US)—Non-Final Office Action—U.S. Appl. No. 14/926,345.
Dec. 17, 2015—(US) Non-Final Office Action—U.S. Appl. No. 14/670,676.
Jan. 20, 2016—(US) Notice of Allowance—U.S. Appl. No. 14/316,971.
Jan. 21, 2016—(US) Notice of Allowance—U.S. Appl. No. 14/485,462.
Aug. 19, 2015—(US) Non-Final Office Action—U.S. Appl. No. 14/589,696.
Sep. 16, 2013—(US) Non-final office action—U.S. Appl. No. 13/431,077.
Sep. 6, 2013—(CN) Office Action—App 201210083604.8.
Mar. 27, 2014—(US) Notice of Allowance—U.S. Appl. No. 13/431,077.
May 1, 2015—(US) Non-Final Office Action—U.S. Appl. No. 14/491,157.
Dec. 24, 2015—(US) Notice of Allowance—U.S. Appl. No. 14/491,157.
Sep. 30, 2013—(CN) Office Action—App 201210083716.3.
Nov. 19, 2013—(JP) Office Action—App 2013-103770.
Jan. 8, 2014—(US) Notice of Allowance—U.S. Appl. No. 13/430,950.
May 27, 2014—(EP) Extended Search Report—App 12161226.1.
Feb. 4, 2015—(US) Notice of Allowance—U.S. Appl. No. 14/289,780.
Jan. 20, 2015—(JP) Notification of Reasons for Refusal—App 2014-042421, Eng Tran.
Jul. 16, 2012—(EP) Search Report—App 12157690.4.
Feb. 19, 2014—(US) Notice of Allowance—U.S. Appl. No. 13/431,074.
Jun. 19, 2014—(US) Non-final office action—U.S. Appl. No. 14/290,188.
Oct. 7, 2014—(US) Notice of Allowance—U.S. Appl. No. 14/290,188.
Feb. 25, 2016—(US) Non-Final Office Action—U.S. Appl. No. 14/316,959.
Feb. 8, 2016—(EP) Extended European Search Report—App 15161221.5.
Sep. 23, 2015—(EP) Extended European Search Report—App 15161223.1.
Sep. 23, 2015—(EP) Extended European Search Report—App 15161224.9.
Sep. 25, 2015—(EP) Extended European Search Report—App 15161229.8.
Sep. 29, 2015—(EP) Extended European Search Report—App 15161242.1.
Feb. 17, 2016—(US) Notice of Allowance—U.S. Appl. No. 14/671,413.
Feb. 18, 2016—(US) Notice of Allowance—U.S. Appl. No. 14/529,221.
Mar. 4, 2016—(US) Notice of Allowance—U.S. Appl. No. 14/491,157.
Mar. 29, 2016—(US) Notice of Allowance—U.S. Appl. No. 14/485,462.
Apr. 1, 2016—(US) Notice of Allowance—U.S. Appl. No. 14/926,345.
Apr. 12, 2016—(US) Notice of Allowance—U.S. Appl. No. 14/611,393.
Apr. 14, 2016—(US) Notice of Allowance—U.S. Appl. No. 14/670,522.
Apr. 26, 2016—(US) Non-Final Office Action—U.S. Appl. No. 15/079,829.
May 9, 2016—(US) Notice of Allowance—U.S. Appl. No. 14/670,489.
May 24, 2016—(US) Notice of Allowance—U.S. Appl. No. 14/485,462.
May 27, 2016—(US) Notice of Allowance—U.S. Appl. No. 141671,413.
Jun. 10, 2016—(US) Notice of Allowance—U.S. Appl. No. 14/316,971.
Jun. 17, 2016—(US) Notice of Allowance—U.S. Appl. No. 14/926,345.
Jun. 17, 2016—(US) Notice of Allowance—U.S. Appl. No. 14/491,157.
May 24, 2016—(EP) Communication—App 12157679.7
Sep. 14, 2015—(EP) Communication—App 12157679.7.
May 24, 2016—(EP) Communication—App 12157690.4.
Sep. 11, 2015—(EP) Communication—App 12157690.4.
Jul. 16, 2012—(EP) Search Report 12157679.7.
Jun. 22, 2016—(US) Notice of Allowance—U.S. Appl. No. 14/529,221.
Apr. 16, 2013 (JP) Notice of Allowance—App. 2011100507.
Feb. 17, 2015 (JP) Notice of Allowance—App. 2011078637.
May 11, 2016—(EP) Communication—App 12161226.1.
Jun. 29, 2016—(US) Notice of Allowance—U.S. Appl. No. 14/611,393.
Jul. 11, 2016—(US) Non-Final Office Action—U.S. Appl. No. 14/670,502.
Jul. 14, 2016—(US) Notice of Allowance—U.S. Appl. No. 14/670,676.
Jul. 15, 2016—(US) Notice of Allowance—U.S. Appl. No. 14/670,522.
Aug. 9, 2016—(US) Notice of Allowance—U.S. Appl. No. 15/079,829.
Sep. 12, 2016—(US) Notice of Allowance—U.S. Appl. No. 14/589,696.
Sep. 28, 2016—(US) Notice of Allowance—U.S. Appl. No. 14/670,801.
Nov. 22, 2016—(JP) Office Action—App 2013137422—Eng Tran.
Dec. 13, 2016—(JP) Office Action—App 2014000609—Eng Tran.
Dec. 13, 2016—(JP) Office Action—App 2013137425—Eng Tran.
Dec. 12, 2016—(JP) Office Action—App 2014074727—Eng Tran.
Dec. 27, 2016—(JP) Office Action—App 2014074728—Eng Tran.
Dec. 27, 2016—(JP) Office Action—App 2014074729—Eng Tran.
Dec. 27, 2016—(JP) Office Action—App 2014074730—Eng Tran.

* cited by examiner

CARTRIDGE

CROSS-REFERENCE TO RELATED APPLICATIONS

This application claims priority from Japanese Patent Application No. 2014-074726 filed on Mar. 31, 2014, the entire contents of which are incorporated herein by reference.

TECHNICAL FIELD

Aspects of the disclosure relates to a cartridge configured to be mounted to an electrophotographic image forming apparatus.

BACKGROUND

As an electrophotographic printer, a printer to which a cartridge accommodating therein developer can be detachably mounted is known.

In the known printer, when a used cartridge is replaced with an unused cartridge, it is necessary to enable the printer to recognize that the non-used cartridge has been mounted.

SUMMARY

It is therefore an object of the disclosure to provide a cartridge capable of enabling an external device to recognize that an unused cartridge has been mounted.

According to an aspect of the disclosure there is provided a cartridge including: a housing configured to accommodate therein developer; a driving receiving part configured to receive a driving force; a rotary member configured to rotate by receiving a driving force from the driving receiving part and move in an axis direction, which is parallel with a rotational axis of the rotary member, while rotating; and a detected member configured to move in the axis direction by receiving a driving force from the rotary member, wherein the rotary member includes: a main body part having a first surface facing the detected member in the axis direction and a second surface positioned at an opposite side of the first surface in the axis direction, an operating part arranged on the first surface and configured to apply a force for moving the detected member in the axis direction to the detected member, and an operated part arranged on the second surface and configured to receive a force for moving the main body part in the axis direction.

DETAILED DESCRIPTION

1. Outline of Developing Cartridge

Figure 1:
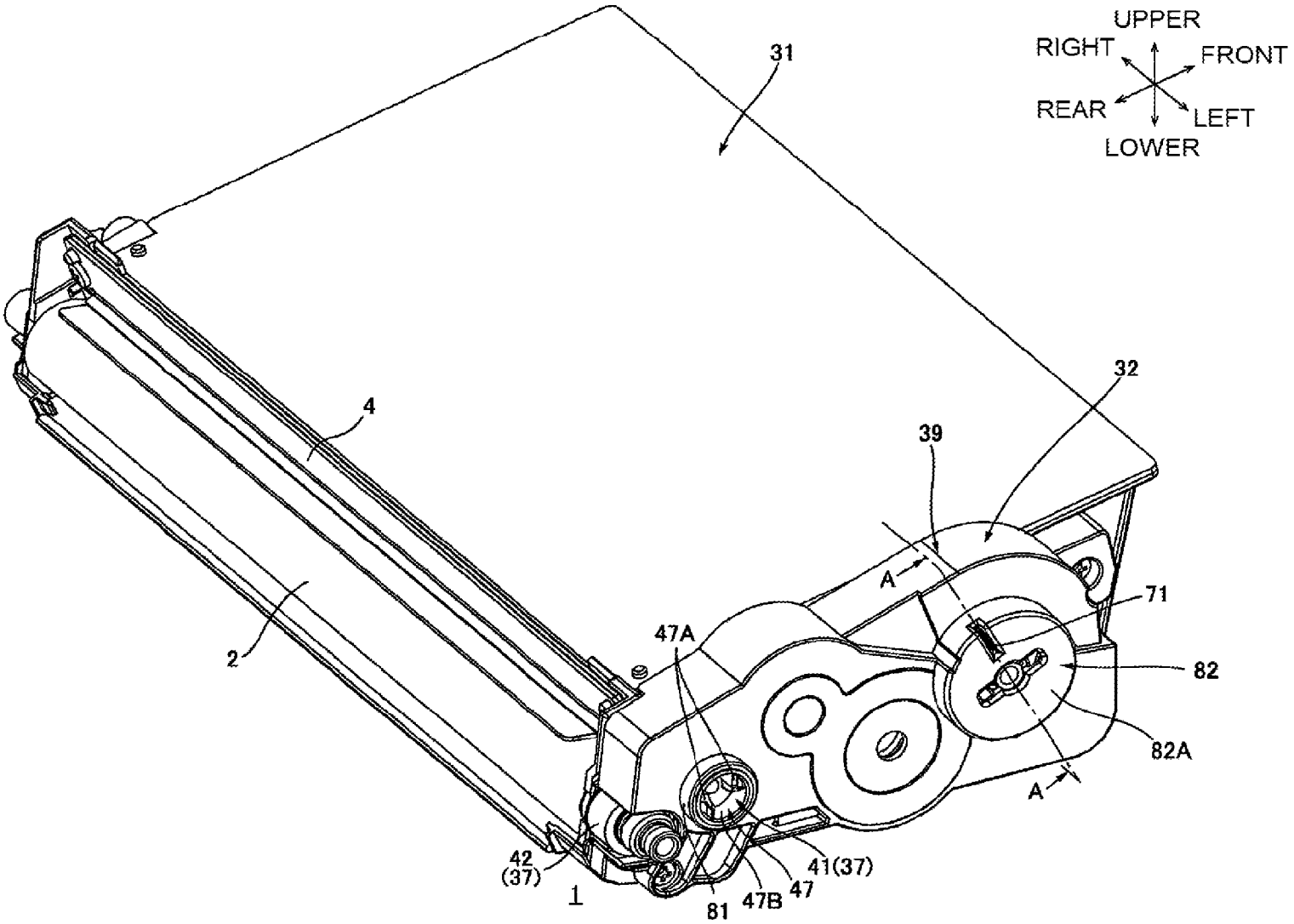
FIG. 1 is a perspective view of a developing cartridge according to a first illustrative embodiment of the cartridge of the disclosure, as seen from a left-rear side.
Figure 2:
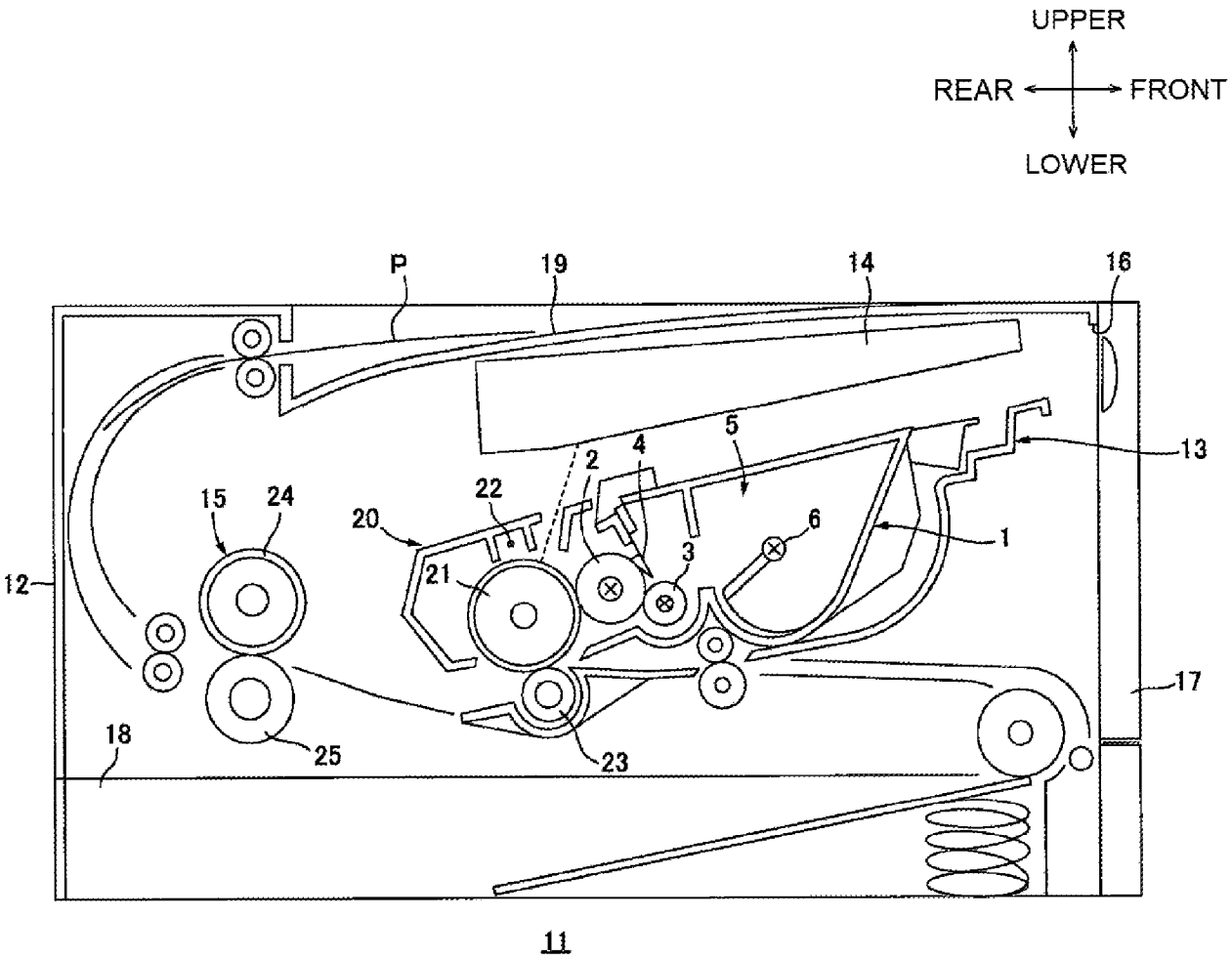
FIG. 2 is a central sectional view of a printer to which the developing cartridge of FIG. 1 is mounted.

As shown in FIGS. 1 and 2, a developing cartridge 1, which is an example of the cartridge, has a developing roller 2, which is an example of the developer carrier, a supply roller 3, a layer thickness regulation blade 4 and a toner accommodation part 5.

In the description hereinafter, directions of the developing cartridge 1 are described on the basis of a state where the developing cartridge 1 is horizontally placed. Specifically, arrow directions indicated in FIG. 1 are used as the basis. A left-right direction is an example of the axis direction.

The developing roller 2 is rotatably supported to a rear end portion of the developing cartridge 1. The developing roller 2 has a substantially cylindrical shape extending in the left-right direction.

The supply roller 3 is arranged at a front-lower side of the developing roller 2. The supply roller 3 is rotatably supported to the developing cartridge 1. The supply roller 3 has a substantially cylindrical shape extending in the left-right direction. The supply roller 3 contacts a front lower end portion of the developing roller 2.

The layer thickness regulation blade 4 is arranged at a front-upper side of the developing roller 2. The layer thickness regulation blade 4 contacts a front end portion of the developing roller 2.

The toner accommodation part 5 is arranged in front of the supply roller 3 and the layer thickness regulation blade 4. The toner accommodation part 5 is configured to accommodate therein toner, which is an example of the developer. The toner accommodation part 5 has an agitator 6.

The agitator 6 is rotatably supported in the toner accommodation part 5.

2. Using Aspects of Developing Cartridge

As shown in FIG. 2, the developing cartridge 1 is used while being mounted to an image forming apparatus 11.

The image forming apparatus 11 is an electrophotographic monochrome printer. The image forming apparatus 11 has an apparatus main body 12, which is an example of the external, a process cartridge 13, a scanner unit 14, and a fixing unit 15.

The apparatus main body 12 has a substantially box shape. The apparatus main body 12 has an opening 16, a front cover 17, a sheet feeding tray 18, and a sheet discharge tray 19.

The opening 16 is arranged at a front end portion of the apparatus main body 12. The opening 16 enables an inside and an outside of the apparatus main body 12 to communicate with each other so that the process cartridge 13 can pass therethrough.

The front cover 17 is arranged at the front end portion of the apparatus main body 12. The front cover 17 has a substantially flat plate shape. The front cover 17 extends in the upper-lower direction, and is swingably supported to a front wall of the apparatus main body 12 at a lower end portion thereof serving as a support point. The front cover 17 is configured to open or close the opening 16.

The sheet feeding tray 18 is arranged at a bottom of the apparatus main body 12. The sheet feeding tray 18 is configured to accommodate therein sheets P.

The sheet discharge tray 19 is arranged at a center of an upper wall of the apparatus main body 12. The sheet discharge tray 19 is recessed downwardly from an upper surface of the apparatus main body 12 so that the sheet P can be placed thereon.

The process cartridge 13 is accommodated at a substantially center of the apparatus main body 12 in the upper-lower direction. The process cartridge 13 is configured to be mounted to or to be detached from the apparatus main body 12. The process cartridge 13 has a drum cartridge 20, and the developing cartridge 1.

The drum cartridge 20 has a photosensitive drum 21, a scorotron-type charger 22, and a transfer roller 23.

The photosensitive drum 21 is rotatably supported to a rear end portion of the drum cartridge 20.

The scorotron-type charger 22 is arranged at an interval from the photosensitive drum 21 at a rear-upper side of the photosensitive drum 21.

The transfer roller 23 is arranged below the photosensitive drum 21. The transfer roller 23 contacts a lower end portion of the photosensitive drum 21.

The developing cartridge 1 is detachably mounted to the drum cartridge 20 so that the developing roller 2 contacts a front end portion of the photosensitive drum 21 at the front of the photosensitive drum 21.

The scanner unit 14 is arranged above the process cartridge 13. The scanner unit 14 is configured to emit a laser beam based on image data toward the photosensitive drum 21.

The fixing unit 15 is arranged at the rear of the process cartridge 13. The fixing unit 15 has a heating roller 24, and a pressing roller 25 pressed to a rear lower end portion of the heating roller 24.

When the image forming apparatus 11 starts an image forming operation, the scorotron-type charger 22 uniformly charges a surface of the photosensitive drum 21. The scanner unit 14 exposes the surface of the photosensitive drum 21. Thereby, an electrostatic latent image based on the image data is formed on the surface of the photosensitive drum 21.

Also, the agitator 6 stirs the toner in the toner accommodation part 5, thereby supplying the same to the supply roller 3. The supply roller 3 supplies the toner supplied by the agitator 6 to the developing roller 2. At this time, the toner is positively friction-charged between the developing roller 2 and the supply roller 3, and is then carried on the developing roller 2. The layer thickness regulation blade 4 regulates a layer thickness of the toner carried on the developing roller 2 to a predetermined thickness.

The toner carried on the developing roller 2 is supplied to the electrostatic latent image on the surface of the photosensitive drum 21. Thereby, a toner image is carried on the surface of the photosensitive drum 21.

The sheet P is fed one by one at predetermined timing from the sheet feeding tray 18 toward between the photosensitive drum 21 and the transfer roller 23 by rotations of a variety of rollers. The toner image on the surface of the photosensitive drum 21 is transferred to the sheet P when the sheet P passes between the photosensitive drum 21 and the transfer roller 23.

Thereafter, the sheet P is heated and pressed while it passes between the heating roller 24 and the pressing roller 25. Thereby, the toner image on the sheet P is heat-fixed to the sheet P. Then, the sheet P is discharged to the sheet discharge tray 19.

3. Details of Developing Cartridge

As shown in FIG. 1, the developing cartridge 1 has a developing frame 31, which is an example of the housing, and a driving unit 32.

(1) Developing Frame

Figure 3A:
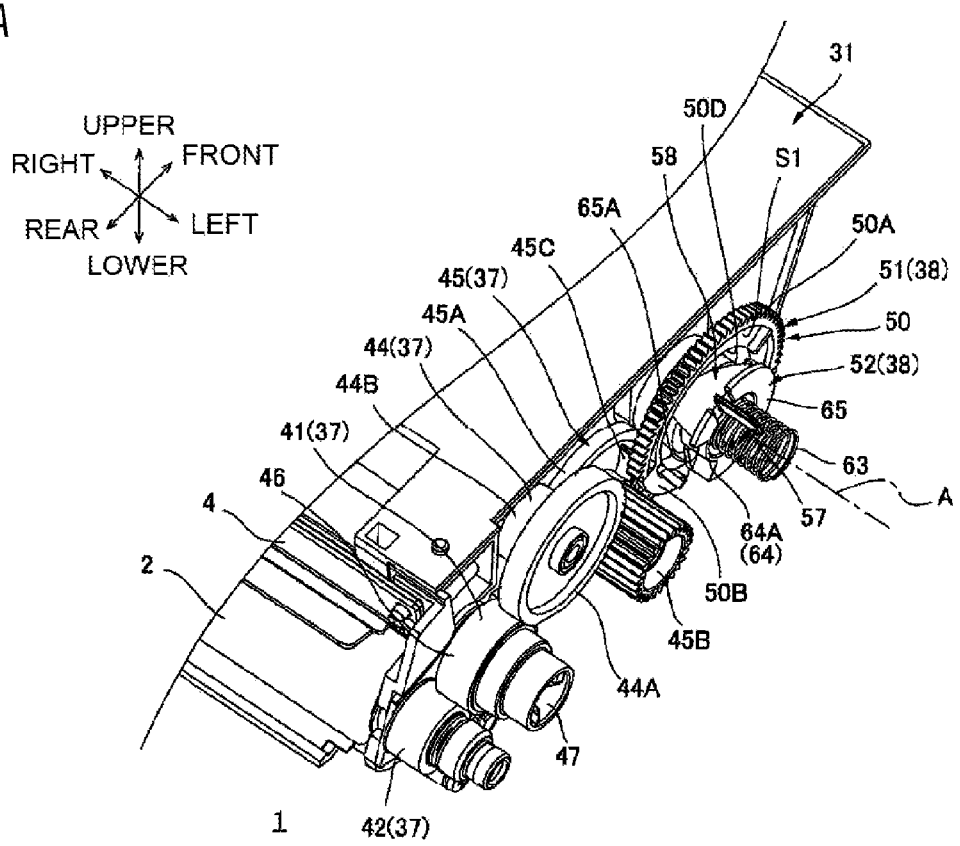
FIG. 3A is a perspective view of the developing cartridge shown in FIG. 1 with a gear cover being detached, as seen from a left-rear side.
Figure 4:
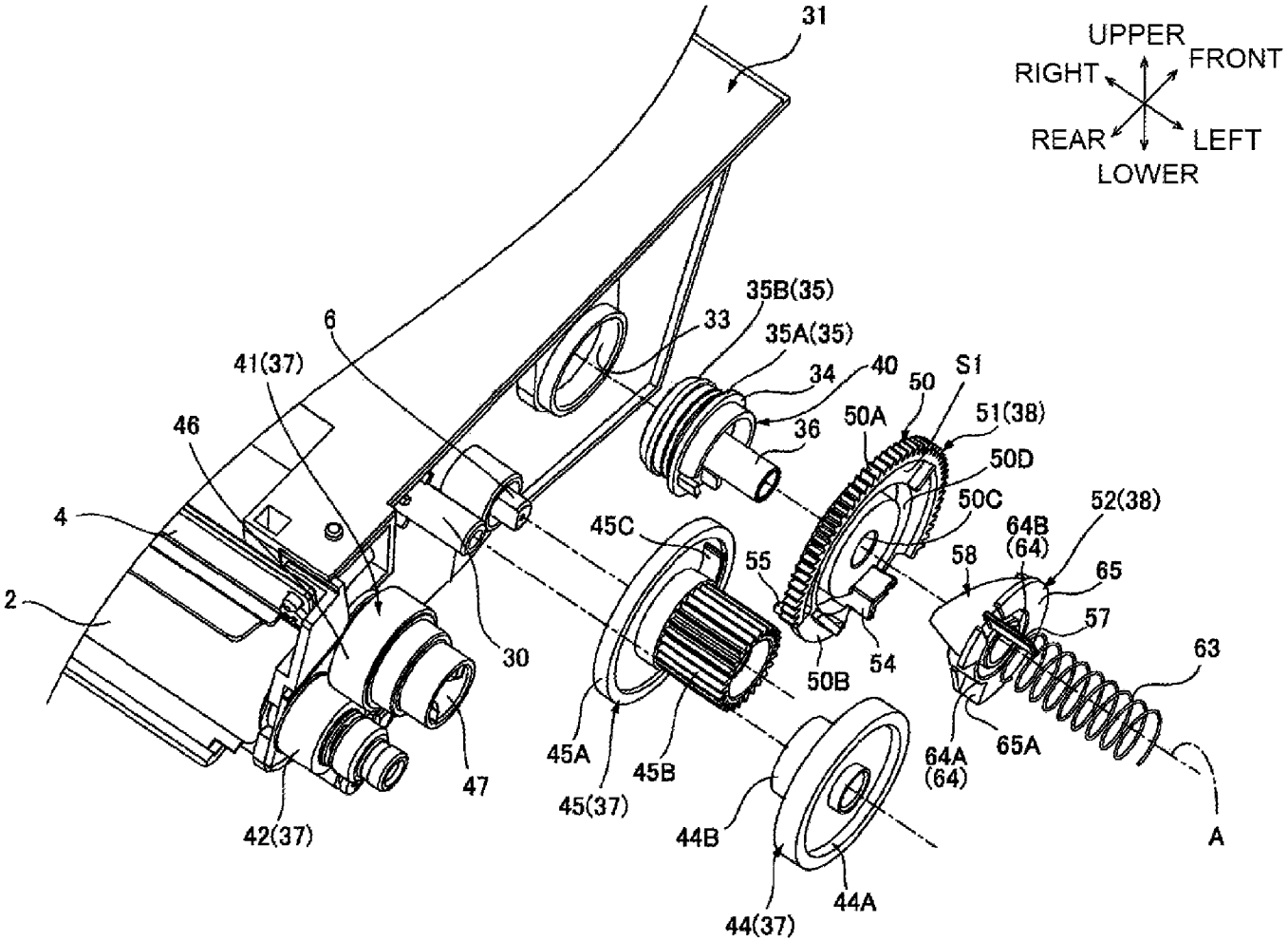
FIG. 4 is an exploded perspective view of the developing cartridge shown in FIG. 3A, as seen from a left-rear side.

The developing frame 31 has a substantially box shape, as shown in FIGS. 3A and 4. The developing frame 31 has the toner accommodation part 5 and supports the developing roller 2, the supply roller 3, the layer thickness regulation blade 4 and the agitator 6. The developing frame 31 has an idle gear support shaft 30, a toner filling port 33, which is an example of the filling port, and a toner cap 34, which is an example of the closing member.

The idle gear support shaft 30 is arranged at a substantially center of an upper end portion of a left wall of the developing frame 31 in the front-rear direction. The idle gear support shaft 30 has a substantially cylindrical shape extending leftward from the left wall of the developing frame 31. The idle gear support shaft 30 is formed integrally with the left wall of the developing frame 31.

The toner filling port 33 is arranged at a front end portion of the left wall of the developing frame 31. The toner filling port 33 has a substantially circular shape, in a side view, and penetrates the left wall of the developing frame 31 in the left-right direction.

Figure 5B:
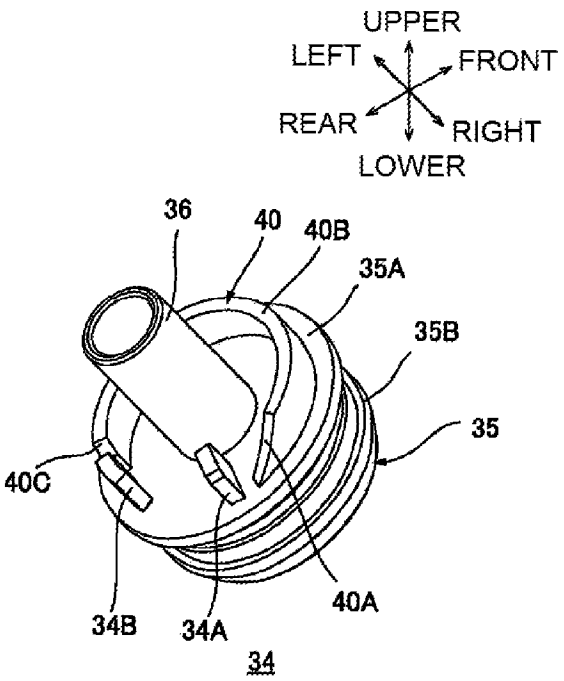
FIG. 5B is a perspective view of the toner cap shown in FIG. 4, as seen from a left-lower side.
Figure 5A:
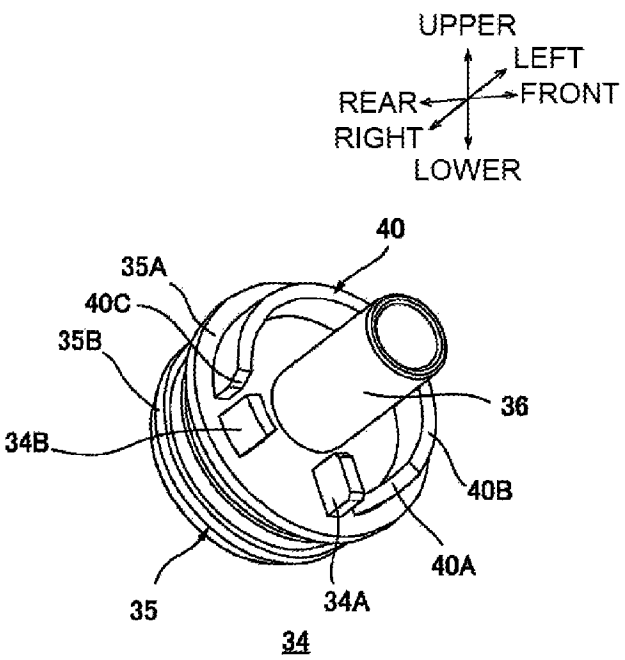
FIG. 5A is a perspective view of a toner cap shown in FIG. 4, as seen from a rear-lower side.

The toner cap 34 is fitted in the toner filling port 33 to close the toner filling port 33. As shown in FIGS. 5A and 5B, the toner cap 34 has a cap main body 35, a support shaft 36, a displacement part 40, which is an example of the second abutment part, a first stopper 34A, and a second stopper 34B.

The cap main body 35 has a substantially cylindrical shape extending in the left-right direction and having a closed left end portion. The cap main body 35 has a closing part 35A and an insertion part 35B.

The closing part 35A is arranged at the left end portion of the cap main body 35. The closing part 35A has a substantially disc shape having a thickness in the left-right direction. An outer diameter of the closing part 35A is greater than an inner diameter of the toner filling port 33.

The insertion part 35B has a substantially cylindrical shape extending rightward from a right surface of the closing part 35A. An outer diameter of the insertion part 35B is smaller than the outer diameter of the closing part 35A and to be slightly greater than the inner diameter of the toner filling port 33. The insertion part 35B is inserted into the toner filling port 33.

The support shaft 36 has a substantially cylindrical shape extending leftward from a substantially center of the left surface of the closing part 35A. A left end portion of the support shaft 36 opens.

The displacement part 40 is arranged at a peripheral edge part of the closing part 35A. The displacement part 40 has a substantially C-shaped flat plate shape protruding leftward from the left surface of the closing part 35A and extending in a circumferential direction of the closing part 35A so as to surround the support shaft 36, in a side view. The displacement part 40 has a first inclined surface 40A, which is an example of the second inclined part, a parallel surface 40B, and a second inclined surface 40C.

The first inclined surface 40A is arranged at an upstream end portion of the displacement part 40 in a counterclockwise direction, as seen from a left side. The first inclined surface 40A continues to the left surface of the closing part 35A, and is inclined leftward toward the downstream side in the counterclockwise direction, as seen from the left side.

The parallel surface 40B continues to a downstream side of the first inclined surface 40A in the counterclockwise direction, as seen from the left side, and extends in the counterclockwise direction, as seen from the left side. The parallel surface 40B is parallel with the left surface of the closing part 35A so that a distance thereof from the left surface of the closing part 35A in the left-right direction is constant.

The second inclined surface 40C is arranged at a downstream end portion of the displacement part 40 in the counterclockwise direction, as seen from the left side. The second inclined surface 40C continues to a downstream side of the parallel surface 40B in the counterclockwise direction, as seen from the left side, and is inclined rightward toward the downstream side in the counterclockwise direction, as seen from the left side.

The first stopper 34A is arranged to face the first inclined surface 40 at an interval therebetween at a rear-lower side of the first inclined surface 40. The first stopper 34A has a substantially flat plate shape protruding leftward from the left surface of the closing part 35A and extending in a diametrical direction of the closing part 35A.

The second stopper 34B is arranged to face the second inclined surface 40C at an interval therebetween at a lower side of the second inclined surface 40C. The second stopper 34B has a substantially flat plate shape protruding leftward from the left surface of the closing part 35A and extending in the circumferential direction of the closing part 35.

(2) Driving Unit

As shown in FIGS. 1 and 3A, the driving unit 32 is arranged at the left of the developing frame 31 at the left end portion of the developing cartridge 1. The driving unit 32 has a gear train 37, a detection unit 38, a gear cover 39, which is an example of the covering member, and a compression spring 63, which is an example of the urging member.

(2-1) Gear Train

Figure 3B:
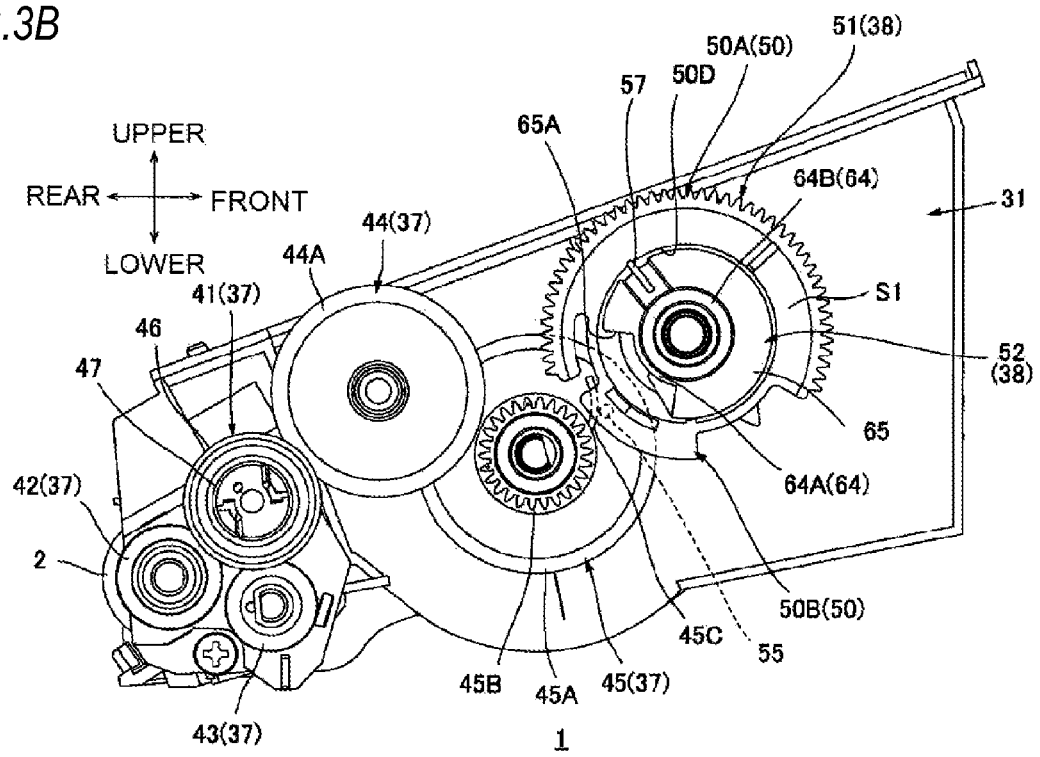
FIG. 3B is a left side view of the developing cartridge shown in FIG. 3A.

As shown in FIGS. 3A and 3B, the gear train 37 has a developing coupling 41, which is an example of the driving receiving part, a developing gear 42, a supply gear 43, an idle gear 44, and an agitator gear 45, which is an example of the transmission member.

The developing coupling 41 is arranged at a rear end portion of the developing cartridge 1. The developing coupling 41 has a substantially cylindrical shape extending in the left-right direction. The developing coupling 41 is rotatably supported to a support shaft (not shown) provided integrally with the left wall of the developing frame 31. The developing coupling 41 has a gear part 46 and a coupling part 47.

The gear part 46 is arranged at a substantially right half part of the developing coupling 41. The gear part 46 has a substantially cylindrical shape extending in the left-right direction and having a closed left end portion. The gear part 46 has gear teeth over an entire circumference thereof.

The coupling part 47 has a substantially cylindrical shape extending leftward from a left wall of the gear part 46 and having an opened left end portion. The coupling part 47 shares a central axis with the gear part 46. The coupling part 47 has a pair of protrusions 47A.

The pair of protrusions 47A are respectively arranged at an interval from each other in a diametrical direction of the coupling part 47 in an inner space 47B of the coupling part 47 in the diametrical direction. Each of the pair of protrusions 47A protrudes inwardly, in the diametrical direction, from an inner peripheral surface of the coupling part 47, and has a substantially rectangular shape, in a side view.

The developing gear 42 is arranged at a rear-lower side of the developing coupling 41. The developing gear 42 has a substantially disc shape having a thickness in the left-right direction. The developing gear 42 has gear teeth over an entire circumference thereof. The developing gear 42 is supported to a left end portion of a rotary shaft of the developing roller 2 so that it cannot be relatively rotated. The developing gear 42 is meshed with a rear lower end portion of the gear part 46 of the developing coupling 41.

The supply gear 43 is arranged below the developing coupling 41. The supply gear 43 has a substantially disc shape having a thickness in the left-right direction. The supply gear 43 has gear teeth over an entire circumference thereof. The supply gear 43 is supported to a left end portion of a rotary shaft of the supply roller 3 so that it cannot be relatively rotated. The supply gear 43 is meshed with a lower end portion of the gear part 46 of the developing coupling 41.

The idle gear 44 is arranged at a front-upper side of the developing coupling 41. The idle gear 44 is rotatably supported to the idle gear support shaft 30. The idle gear 44 integrally has a large diameter gear 44A and a small diameter gear 44B.

The large diameter gear 44A is arranged at a left end portion of the idle gear 44. The large diameter gear 44A has a substantially disc shape having a thickness in the left-right direction. The large diameter gear 44A has gear teeth over an entire circumference thereof. The large diameter gear 44A is meshed with a front upper end portion of the gear part 46 of the developing coupling 41.

The small diameter gear 44B has a substantially cylindrical shape extending rightward from a right surface of the large diameter gear 44A. The small diameter gear 44B shares a central axis with the large diameter gear 44A. An outer diameter of the small diameter gear 44B is smaller than an outer diameter of the large diameter gear 44A. The small diameter gear 44B has gear teeth over an entire circumference thereof.

The agitator gear 45 is arranged at a front-lower side of the idle gear 44. The agitator gear 45 is supported to a left end portion of a rotary shaft of the agitator 6 so that it cannot be relatively rotated. The agitator gear 45 has a first gear part 45A, a second gear part 45B, which is an example of the transmitting part, and an abutting rib 45C, which is an example of the engaging part.

The first gear part 45A is arranged at a right end portion of the agitator gear 45. The first gear part 45A has a substantially disc shape having a thickness in the left-right direction. The first gear part 45A has gear teeth over an entire circumference thereof. The first gear part 45A is meshed with a front lower end portion of the small diameter gear 44B of the idle gear 44.

The second gear part 45B has a substantially cylindrical shape extending leftward from a left surface of the first gear part 45A. The second gear part 45B shares a central axis with the first gear part 45A. An outer diameter of the second gear part 45B be smaller than an outer diameter of the first gear part 45A. The second gear part 45B has gear teeth over an entire circumference thereof. The second gear part 45B has an interval from the large diameter gear 44A of the idle gear 44.

The abutting rib 45C protrudes leftwards from the left surface of the first gear part 45A at an outer side of the second gear part 45B in the diametrical direction. The abutting rib 45C extends so that it is inclined in the counterclockwise direction toward the outer side of the agitator gear 45 in the diametrical direction, as seen from a left side, and has a substantially flat plate shape.

(2-2) Detection Unit

The detection unit 38 has a toothless gear 51, which is an example of the rotary member, and a detection member 52, which is an example of the detected member.

(2-2-1) Toothless Gear

Figure 6A:
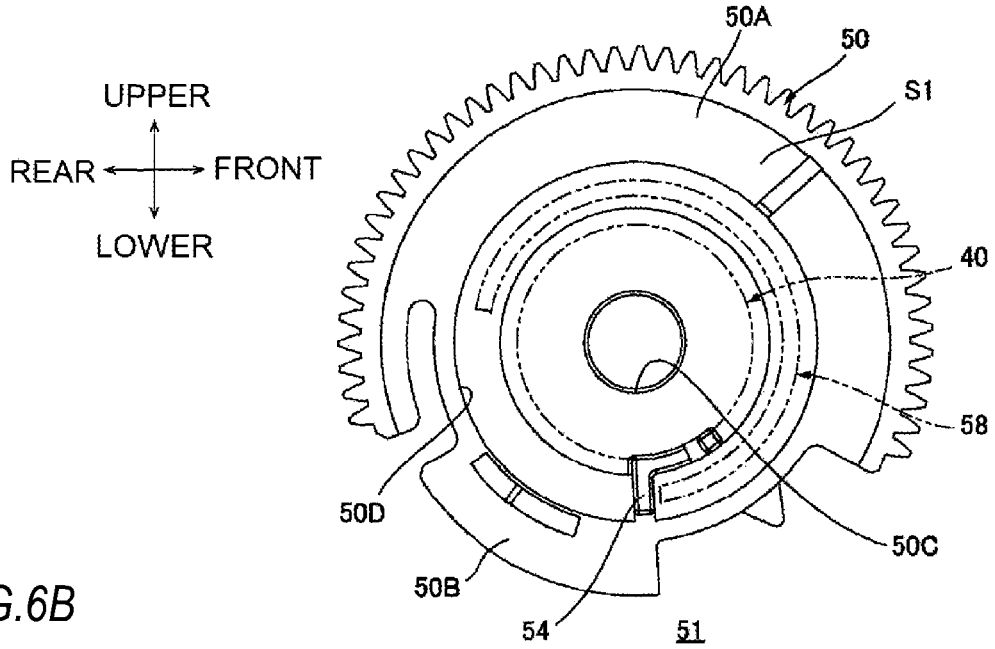
FIG. 6A is a left side view of a toothless gear shown in FIG. 4.
Figure 6B:
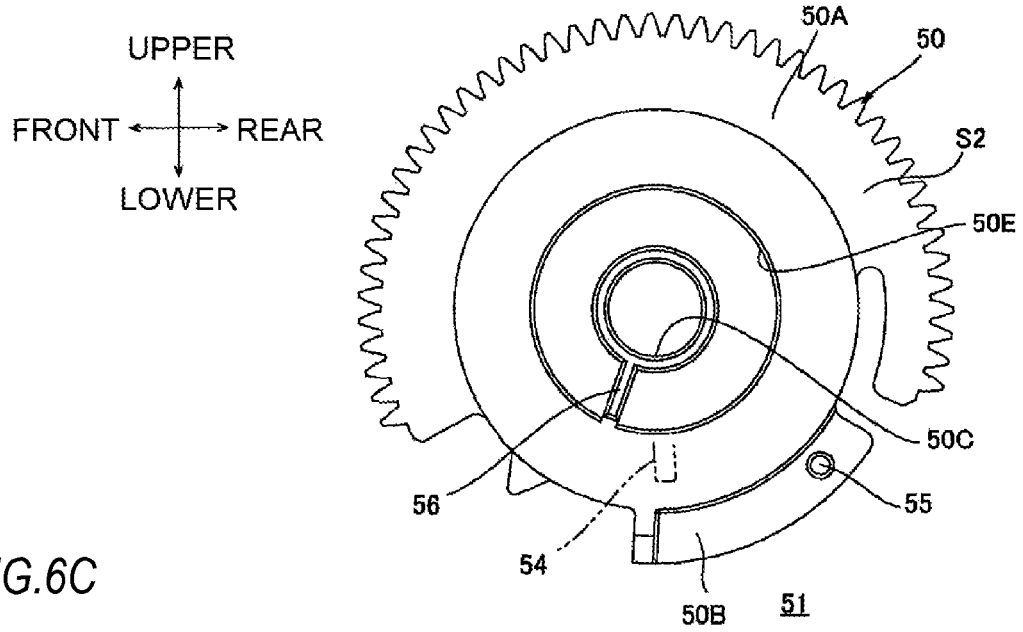
FIG. 6B is a right side view of the toothless gear shown in FIG. 6A.
Figure 6C:
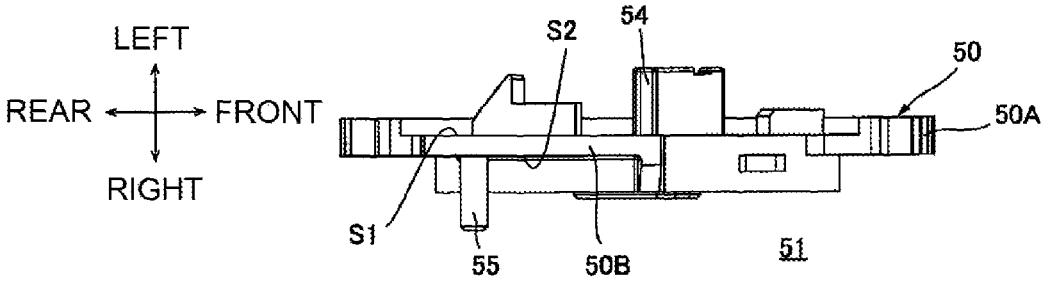
FIG. 6C is a bottom view of the toothless gear shown in FIG. 6A.

As shown in FIGS. 6A, 6B and 6C, the toothless gear 51 has a substantially disc shape having a thickness in the left-right direction. The toothless gear 51 has a main body part 50, a boss 55, which is an example of the engaged part, a first slide part 54, which is an example of the operating part, and a second slide part 56, which is an example of the operated part.

The main body part 50 has a substantially disc shape having a thickness in the left-right direction. A left surface S1 of the main body part 50 is an example of the first surface. A right surface S2 of the main body part 50 is an example of the second surface. The main body part 50 has a teeth part 50A, which is an example of the transmitted part, a toothless part 50B, an insertion hole 50C, a first recess portion 50D, and a second recess portion 50E.

The teeth part 50A is a part occupying about two-thirds (⅔) of the main body part 50 in a circumferential direction, and corresponds to a fan-shaped part having a central angle of about 240° of the main body part 50, in a side view. The teeth part 50A has gear teeth over an entire circumference.

The toothless part 50B is a part occupying about one-third (⅓) of the main body part 50 in the circumferential direction, except for the teeth part 50A, and corresponds to a fan-shaped part having a central angle of about 120° of the main body part 50, in a side view. The toothless part 50B does not have gear teeth.

The insertion hole 50C is arranged at a central portion of the main body part 50 in the diametrical direction. The insertion hole 50C penetrates the main body part 50 in the left-right direction, and has a substantially circular shape, in a side view. An inner diameter of the insertion hole 50C is substantially the same as an outer diameter of the support shaft 36 of the toner cap 34.

Figure 9A:
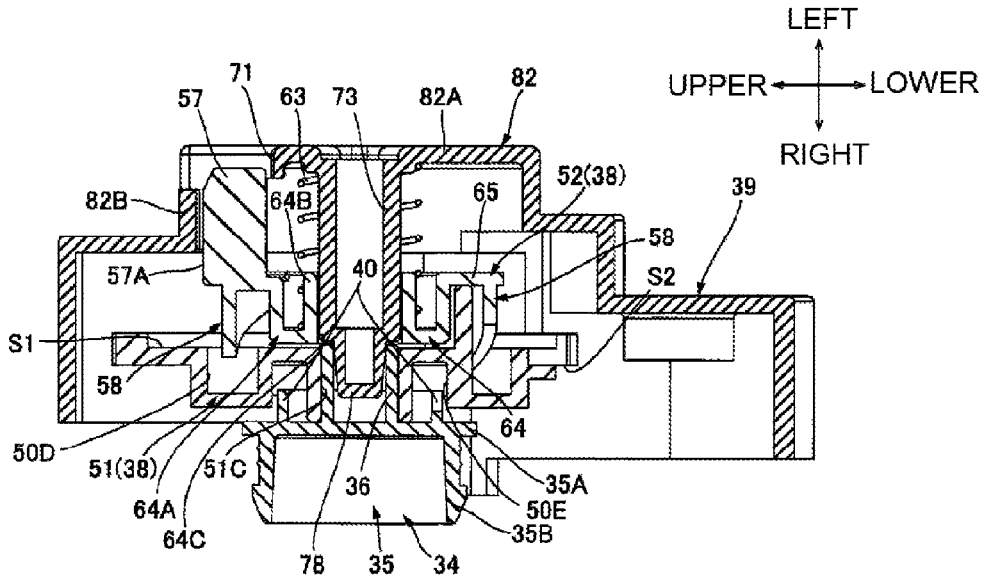
FIG. 9A is a sectional view taken along a line A-A of FIG. 1.

As shown in FIGS. 6A and 9A, the first recess portion 50D is arranged at an interval from the insertion hole 50C at an outer side of the insertion hole 50C in the diametrical direction. The first recess portion 50D is recessed rightward from the left surface S1 of the main body part 50, and extends in the circumferential direction of the main body part 50 to surround the insertion hole 50C. The first recess portion 50D has a substantially circular ring shape, as seen from the left side.

The second recess portion 50E is arranged at an interval from the insertion hole 50C and the first recess portion 50D at an outer side of the insertion hole 50C in the diametrical direction and at an inner side of the first recess portion 50D in the diametrical direction. The second recess portion 50E is recessed leftward from the right surface S2 of the main body part 50, and extends in the circumferential direction of the main body part 50 to surround the insertion hole 50C. The second recess portion 50E has a substantially circular ring shape, as seen from the right side.

The boss 55 is arranged at an upstream end portion of the toothless part 50B in the counterclockwise direction, as seen from the left side. The boss 55 has a substantially cylindrical shape protruding rightward from the right surface of the toothless part 50B.

The first slide part 54 is arranged upstream from an upstream end portion of the first recess portion 50D in the counterclockwise direction, as seen from the left side. The first slide part 54 has a substantially flat plate shape protruding leftward from the left surface of the toothless part 50B and extending in the diametrical direction of the toothless gear 51.

The second slide part 56 is arranged in the second recess portion 50E so that it is close to an inner side of the first slide part 54 in the diametrical direction, when projected in the left-right direction. The second slide part 56 has a substantially flat plate shape protruding rightward from a bottom of the second recess portion 50E and extending in the diametrical direction of the toothless gear 51.

(2-2-2) Detection Member

Figure 7A:
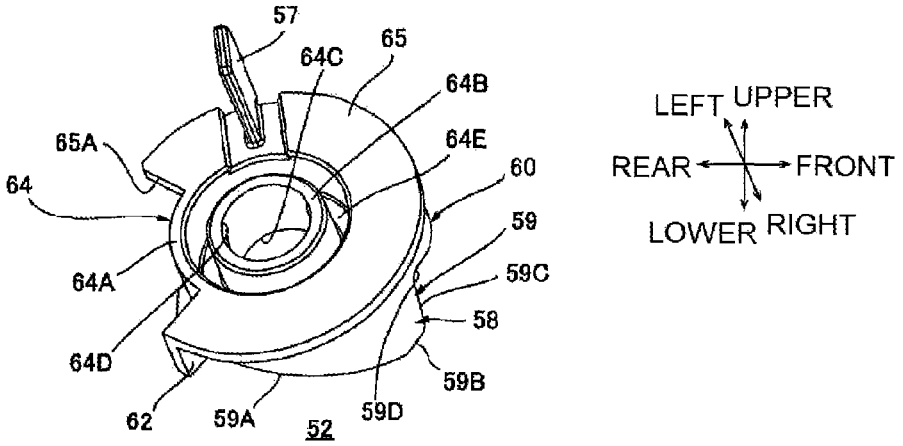
FIG. 7A is a perspective view of a detection member shown in FIG. 4, as seen from a left-lower side.

As shown in FIGS. 4 and 7, the detection member 52 has a substantially cylindrical shape extending in the left-right direction. The detection member 52 has a cylindrical part 64, a collar part 65, a detection projection 57, which is an example of the detected member, a plurality of, specifically, two displacement parts 58, which are an example of the first abutment part, and a stopper 62.

The cylindrical part 64 is arranged at a central portion of the detection member 52 in the diametrical direction. The cylindrical part 64 has an outer cylinder 64A and an inner cylinder 64B.

The outer cylinder 64A has a substantially cylindrical shape extending in the left-right direction and having a closed right end portion. The outer cylinder 64A has an insertion hole 64C.

The insertion hole 64C is arranged at a central portion of a right wall 64E of the outer cylinder 64A in the diametrical direction. The insertion hole 64C penetrates the right wall 64E of the outer cylinder 64A in the left-right direction and has a substantially circular shape, in a side view. A center of the insertion hole 64C coincides with a central axis of the outer cylinder 64A, when projected in the left-right direction.

The inner cylinder 64B is arranged at an inner side of the outer cylinder 64A in the diametrical direction. The inner cylinder 64B extends leftward continuously from a peripheral edge part of the insertion hole 64C at the diametrical center of the right wall 64E of the outer cylinder 64A, and has a substantially cylindrical shape. A central axis of the inner cylinder 64B coincides with the central axis of the outer cylinder 64A. An inner diameter of the inner cylinder 64B is the same as an inner diameter of the insertion hole 64C. As shown in FIG. 7C, the inner cylinder 64B has a pair of engaging projections 64D.

The pair of engaging projections 64D is respectively arranged on both inner surfaces of the inner cylinder 64B in the diametrical direction. Each of the pair of engaging projections 64D is a protrusion protruding inward, in the diametrical direction, from the inner surface of the inner cylinder 64B and extending circumferentially.

The collar part 65 protrudes outward, in the diametrical direction, from an outer surface of a left end portion of the outer cylinder 64A in the diametrical direction and extends in the circumferential direction of the outer cylinder 64A. The collar part 65 has a substantially C-shaped plate shape of which a rear end portion is notched over about a quarter (¼) thereof in the circumferential direction, in a side view. In other words, a notched portion 65A of the collar part 65 is notched forward from a rear end edge of the collar part 65. The notched portion 65A of the collar part 65 is an example of the notched part of the detection member 52.

The detection projection 57 is arranged at an upper end portion of the collar part 65. The detection projection 57 has a substantially flat plate shape protruding leftward from the left surface of the collar part 65 and extending in the diametrical direction of the detection member 52.

Figure 7B:
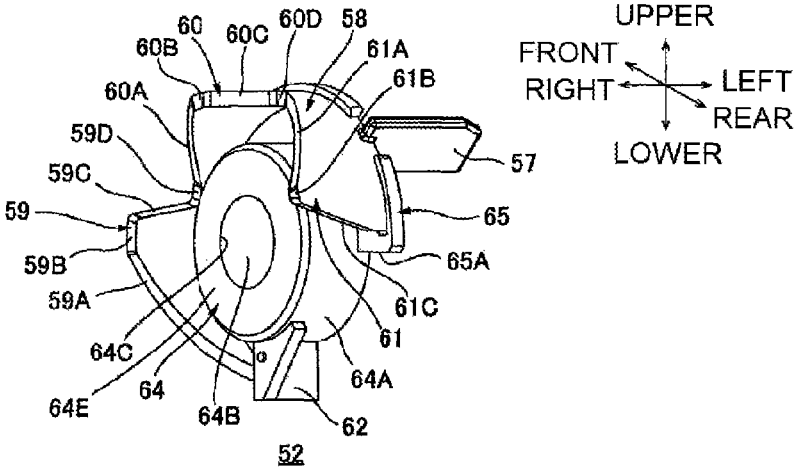
FIG. 7B is a perspective view of the detection member shown in FIG. 7A, as seen from a rear-lower side.
Figure 7C:
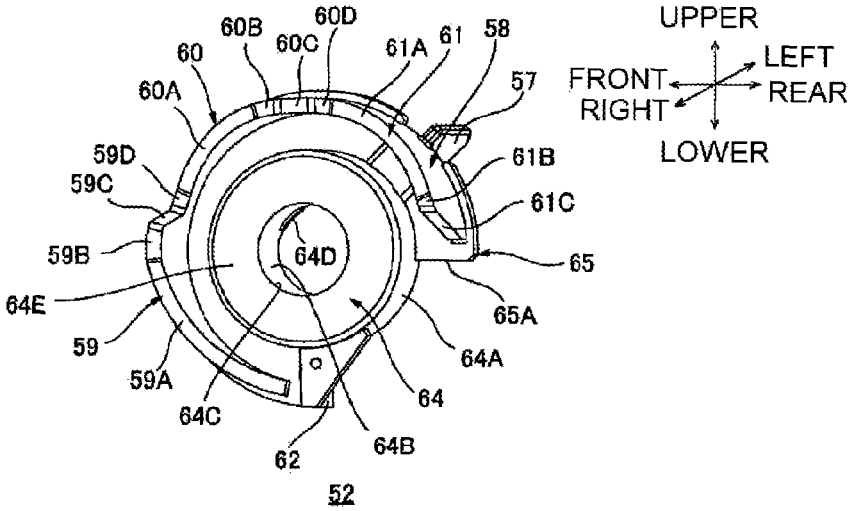
FIG. 7C is a perspective view of the detection member shown in FIG. 7A, as seen from a right-rear side.

As shown in FIGS. 7B and 7C, the displacement part 58 is arranged at the peripheral edge part of the collar part 65. The displacement part 58 has a substantially C-shaped flat plate shape protruding rightward from the right surface of the peripheral edge part of the collar part 65 and extending in the circumferential direction of the collar part 65. The displacement part 58 has a first displacement part 59, a second displacement part 60, and a third displacement part 61.

The first displacement part 59 is arranged at an upstream end portion of the displacement part 58 in the counterclockwise direction, as seen from the left side. The first displacement part 59 has a first inclined surface 59A, which is an example of the first inclined part, a first parallel surface 59B, a second inclined surface 59C, and a second parallel surface 59D.

The first inclined surface 59A is arranged at an upstream end portion of the first displacement part 59 in the counterclockwise direction, as seen from the left side. The first inclined surface 59A continues to the right surface of the collar part 65 and is inclined rightward toward the downstream side in the counterclockwise direction, as seen from the left side.

The first parallel surface 59B continues to a downstream side of the first inclined surface 59A in the counterclockwise direction, as seen from the left side, and extends in the counterclockwise direction, as seen from the left side. The first parallel surface 59B is parallel with the right surface of the collar part 65 so that a distance thereof from the right surface of the collar part 65 in the left-right direction is constant.

The second inclined surface 59C continues to a downstream side of the first parallel surface 59B in the counterclockwise direction, as seen from the left side, and is inclined leftward toward the downstream side in the counterclockwise direction, as seen from the left side.

The second parallel surface 59D continues to a downstream side of the second inclined surface 59C in the counterclockwise direction, as seen from the left side, and extends in the counterclockwise direction, as seen from the left side. The second parallel surface 59D is parallel with the right surface of the collar part 65 so that a distance thereof from the right surface of the collar part 65 in the left-right direction is constant.

The second displacement part 60 is arranged to continue to a downstream side of the first displacement part 59 in the counterclockwise direction, as seen from the left side. The second displacement part 60 has a first inclined surface 60A, which is an example of the first inclined part, a first parallel surface 60B, a second inclined surface 60C, and a second parallel surface 60D.

The first inclined surface 60A is arranged at an upstream end portion of the second displacement part 60 in the counterclockwise direction, as seen from the left side. The first inclined surface 60A continues to the second parallel surface 59D of the first displacement part 59 and is inclined rightward toward the downstream side in the counterclockwise direction, as seen from the left side.

The first parallel surface 60B continues to a downstream side of the first inclined surface 60A in the counterclockwise direction, as seen from the left side, and extends in the counterclockwise direction, as seen from the left side. The first parallel surface 60B is parallel with the right surface of the collar part 65 so that a distance thereof from the right surface of the collar part 65 in the left-right direction is constant.

The second inclined surface 60C continues to a downstream side of the first parallel surface 60B in the counterclockwise direction, as seen from the left side, and is inclined leftward toward the downstream side in the counterclockwise direction, as seen from the left side.

The second parallel surface 60D continues to a downstream side of the second inclined surface 60C in the counterclockwise direction, as seen from the left side, and extends in the counterclockwise direction, as seen from the left side. The second parallel surface 60D is parallel with the right surface of the collar part 65 so that a distance thereof from the right surface of the collar part 65 in the left-right direction is constant.

The third displacement part 61 is arranged to continue to a downstream side of the second displacement part 60 in the counterclockwise direction, as seen from the left side. The third displacement part 61 has a first inclined surface 61A, which is an example of the first inclined part, a parallel surface 61B, and a second inclined surface 61C.

The first inclined surface 61A is arranged at an upstream end portion of the third displacement part 61 in the counterclockwise direction, as seen from the left side. The first inclined surface 61A continues to the second parallel surface 60D of the second displacement part 60 and is inclined rightward toward the downstream side in the counterclockwise direction, as seen from the left side.

The parallel surface 61B continues to a downstream side of the first inclined surface 61A in the counterclockwise direction, as seen from the left side, and extends in the counterclockwise direction, as seen from the left side. The parallel surface 61B is parallel with the right surface of the collar part 65 so that a distance thereof from the right surface of the collar part 65 in the left-right direction is constant.

The second inclined surface 61C continues to a downstream side of the parallel surface 61B, in the counterclockwise direction, as seen from the left side, and is inclined leftward toward the downstream side in the counterclockwise direction, as seen from the left side.

The stopper 62 has a substantially flat plate shape protruding rightward from the upstream end portion of the collar part 65 in the counterclockwise direction, in a side view, and extending in the diametrical direction of the collar part 65. The displacement part 58 includes the first inclined surface 59A at an upstream side in the counterclockwise direction, as seen from the left side. The stopper 62 faces the first inclined surface 59A at an interval therebetween at an upstream side in the counterclockwise direction, as seen from the left side.

(2-3) Gear Cover and Compression Spring

As shown in FIGS. 1 and 8A, the gear cover 39 is supported to the left end portion of the developing frame 31. The gear cover 39 has a substantially square tube shape extending in the left-right direction and having a closed left end portion. The gear cover 39 covers the gear train 37 and the detection unit 38. The gear cover 39 has a coupling collar 81 and a detection member accommodation part 82.

The coupling collar 81 is arranged at a rear end portion of the gear cover 39. The coupling collar 81 has a substantially cylindrical shape penetrating a left wall of the gear cover 39 and extending in the left-right direction. An inner diameter of the coupling collar 81 is substantially the same as an outer diameter of the coupling part 47 of the developing coupling 41. The coupling part 47 of the developing coupling 41 is rotatably fitted in the coupling collar 81.

The detection member accommodation part 82 is arranged at a front end portion of the gear cover 39. The detection member accommodation part 82 has a substantially cylindrical shape extending leftward from a left surface of the gear cover 39 and having a closed left end portion. A left wall 82A of the detection member accommodation part 82 is an example of the covering part. In the meantime, a right end portion of the detection member accommodation part 82 communicates with an inside of the gear cover 39. The detection member accommodation part 82 accommodates therein the detection member 52. The detection member accommodation part 82 has a slit 71 and a support shaft 73.

The slit 71 is arranged at an upper end portion of the detection member accommodation part 82. The slit 71 penetrates the left wall 82A of the detection member accommodation part 82 in the left-right direction and extends in a diametrical direction of the detection member accommodation part 82.

The support shaft 73 has a substantially cylindrical shape extending rightward from a diametrical center of the left wall 82A of the detection member accommodation part 82. An outer diameter of the support shaft 73 is the same as the inner diameter of the insertion hole 64C of the detection member 52. The support shaft 73 has guide recesses 74, engaging claws 75 and a protrusion 78.

The guide recesses 74 are arranged at both end portions of the support shaft 73 in the front-rear direction. The guide recess 74 is recessed inward, in the diametrical direction, from an outer peripheral surface of the support shaft 73 and extends in the left-right direction.

The engaging claw 75 is arranged in a right end portion of the guide recess 74. The engaging claw 75 protrudes outward, in the diametrical direction, from an inner surface of the guide recess 74 in the diametrical direction. An outer surface of the engaging claw 75 in the diametrical direction is inclined toward the outer side in the diametrical direction toward the left side.

The protrusion 78 is arranged at a right end portion of the support shaft 73. The protrusion 78 has a substantially cylindrical shape protruding rightward from a right surface of the support shaft 73 and having a diameter that is gradually decreased toward the right side. The protrusion 78 is fitted in a left end portion of the support shaft 36 (see FIG. 4) of the toner cap 34. Thereby, the support shaft 73 of the gear cover 39 configures a support part, together with the support shaft 36 of the toner cap 34.

As shown in FIG. 3A, the compression spring 63 is a coil spring extending in the left-right direction. A left end portion of the compression spring 63 abuts on the left wall 82A of the detection member accommodation part 82 of the gear cover 39. A right end portion of the compression spring 63 abuts on the right wall 64E of the outer cylinder 64A of the detection member 52. Thereby, the compression spring 63 always urges the detection member 52 rightward toward the developing frame 31.

(2-4) Mounted State of Detection Unit

Hereinafter, a mounted state of the detection unit 38 is described.

As shown in FIGS. 3A and 4A, the toothless gear 51 is rotatably supported to the support shaft 36 of the toner cap 34.

The support shaft 36 of the toner cap 34 is fitted in the insertion hole 50C of the toothless gear 51 so that it can be relatively rotated.

As shown in FIG. 9A, the displacement part 40 of the toner cap 34 is arranged in the second recess portion 50E of the toothless gear 51. The second slide part 56 of the toothless gear 51 is arranged between the first inclined surface 40A (see FIG. 5B) of the toner cap 34 and the first stopper 34A (see FIG. 5B). Also, the toothless gear 51 is located at a close position adjacent to the developing frame 31.

The detection member 52 is supported to the support shaft 73 of the gear cover 39 so that it cannot rotate and can move in the left-right direction.

The support shaft 73 of the gear cover 39 is fitted in the insertion hole 64C and the inner cylinder 64B of the detection member 52. The engaging projections 64D (see FIG. 7C) of the detection member 52 are fitted in the guide recesses 74 (see FIG. 8) at the left of the engaging claws 75 (see FIG. 8). Thereby, the detection member 52 is restrained from rotating and from further moving rightward.

Also, as shown in FIGS. 1 and 3A, the left end portion of the detection projection 57 is arranged in the slit 71 of the gear cover 39.

As shown in FIG. 3A, at a state where the developing cartridge 1 is not used yet, i.e., the developing cartridge 1 is a new product, a downstream end portion of the teeth part 50A of the toothless gear 51 in the counterclockwise direction is arranged at an interval above the front of the second gear part 45B of the agitator gear 45, as seen from a left side. A position of the toothless gear 51 at that time is an example of the first position.

Also, as shown in FIG. 6A, the right end portion of the displacement part 58 of the detection member 52 is arranged in the first recess portion 50D of the toothless gear 51. As shown in FIG. 9, the first slide part 54 of the toothless gear 51 faces the rear of the first inclined surface 59A of the detection member 52. Also, the detection member 52 is located at a retreat position at which the detection projection 57 is retreated into the gear cover 39.

4. Details of Apparatus Main Body

Figure 9B:
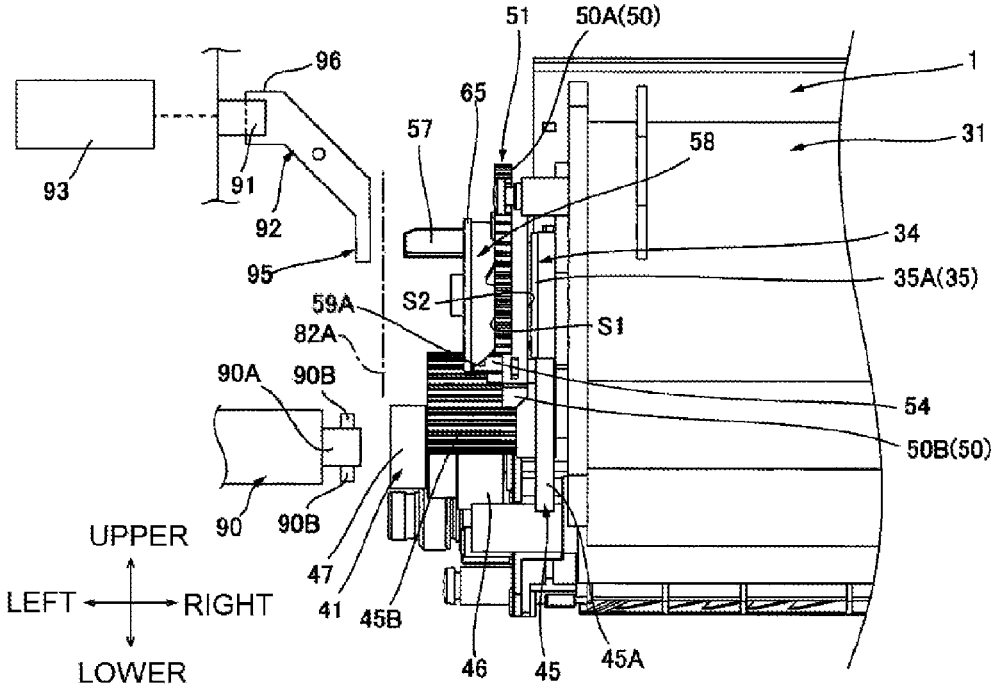
FIG. 9B is a front view of a developing cartridge shown in FIG. 3A.

As shown in FIG. 9B, the apparatus main body 12 has a main body coupling 90, an optical sensor 91, an actuator 92, and a control unit 93.

The main body coupling 90 is arranged in the apparatus main body 12 so that it is positioned at the left of the developing cartridge 1. The main body coupling 90 has a substantially cylindrical shape extending in the left-right direction. The main body coupling 90 operates in accordance with the opening and closing of the front cover 17 of the apparatus main body 12. That is, when the front cover 17 is opened, the main body coupling 90 is retreated leftward to separate from the developing cartridge 1. When the front cover 17 is closed, the main body coupling 90 is advanced rightward toward the developing cartridge 1. The main body coupling 90 has an engaging part 90A.

The engaging part 90A is arranged at a right end portion of the main body coupling 90. The engaging part 90A has a substantially cylindrical shape protruding rightward from the right end portion of the main body coupling 90. The engaging part 90A is inserted in the inner space 47B (see FIG. 1) of the coupling part 47 of the developing coupling 41 in the diametrical direction when the main body coupling 90 is advanced toward developing cartridge 1. The engaging part 90A has a pair of engaging projections 90B.

Each of the pair of engaging projections 90B has a substantially rectangular column shape extending outward, in the diametrical direction, from each of both diametrical surfaces of the engaging part 90A, in a side view. The pair of engaging projections 90B faces the pair of protrusions 47A of the coupling part 47 when the engaging part 90A is inserted into the inner space 47B (see FIG. 1) in the diametrical direction.

The optical sensor 91 is arranged in the apparatus main body 12 so that it is positioned at a left-upper side of the developing cartridge 1. The optical sensor 91 has a light emitting device and a light receiving device facing each other at an interval. The light emitting device always emits detection light toward the light receiving device. The light receiving device receives the detection light emitted from the light emitting device. The optical sensor 91 generates a light receiving signal when the light receiving device receives the detection light, and does not generate a light receiving signal when the light receiving device does not receive the detection light. The optical sensor 91 is electrically connected to the control unit 93.

The actuator 92 is arranged at the right of the optical sensor 91. The actuator 92 has a substantially rod shape extending in left-upper and right-lower directions and is rotatably supported at a predetermined part thereof in the upper-lower direction in the apparatus main body 12. The actuator 92 can be rotated to a non-detection position (see FIG. 9B) at which the detection light of the optical sensor 91 is shielded and a detection position at which the detection light of the optical sensor 91 is not shielded. The actuator 92 is all the time urged toward the non-detection position by an urging member (not shown). The actuator 92 has a pressed part 95 and a light shielding part 96.

The pressed part 95 is arranged at a right lower end portion of the actuator 92. The pressed part 95 has a substantially flat plate shape extending in the front-rear and upper-lower directions.

Figures 11A, 11B, 11C:
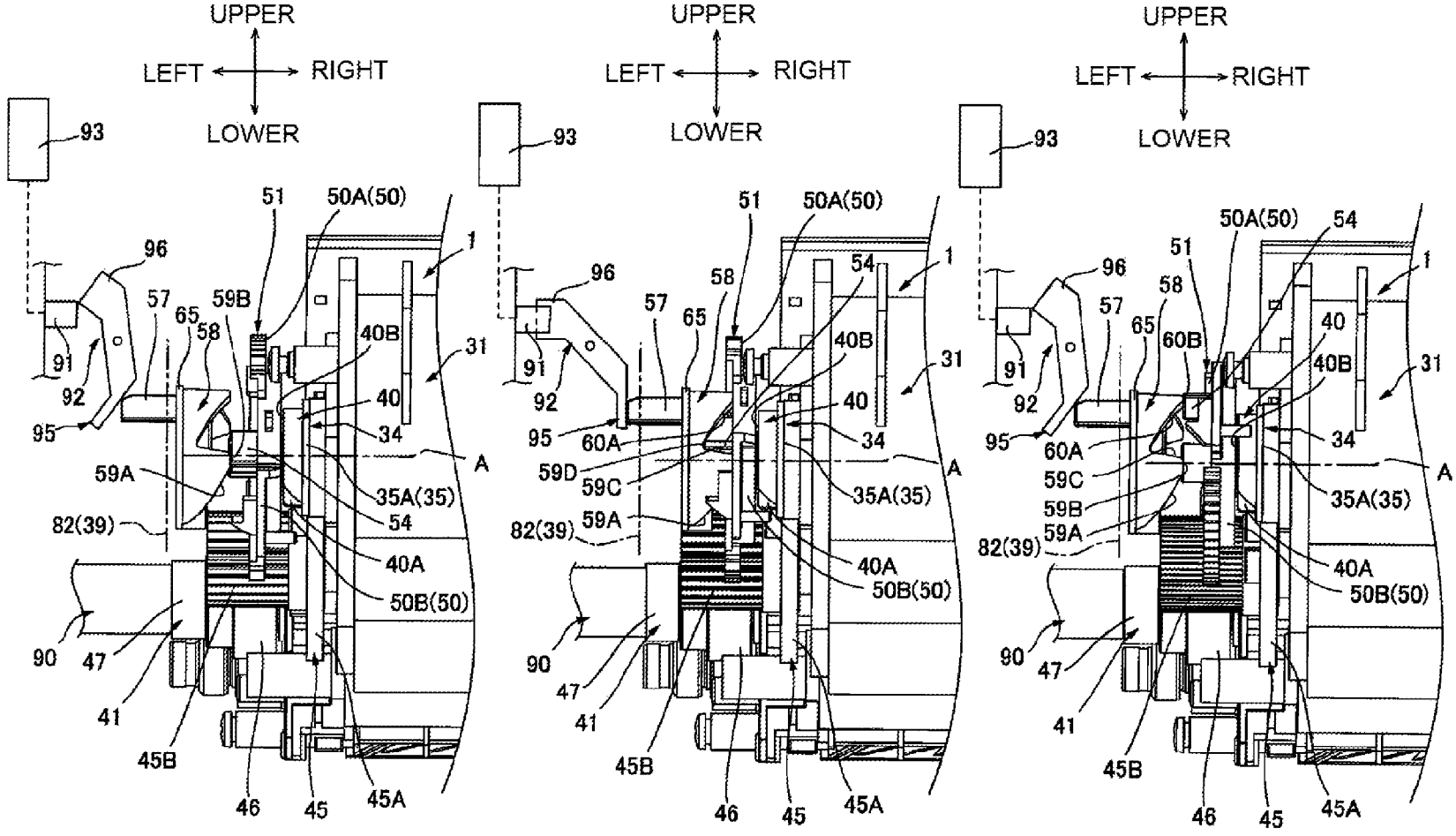
FIG. 11A illustrates the new product detection operation of the developing cartridge subsequent to FIG. 10B, which illustrates a state where the first slide part of the toothless gear abuts on a parallel surface of the first displacement part of the detection member, a second slide part of the toothless gear abuts on a parallel surface of a first displacement part of the toner cap, the detection member is located at an advance position and an actuator is located at a detection position.
FIG. 11B illustrates the new product detection operation of the developing cartridge subsequent to FIG. 11A, which illustrates a state where the first slide part of the toothless gear separates from the first displacement part of the detection member, the detection member is retreated rightward and the actuator is located at a non-detection position.
FIG. 11C illustrates the new product detection operation of the developing cartridge subsequent to FIG. 11B, which illustrates a state where the first slide part of the toothless gear abuts on a parallel surface of a second displacement part of the detection member, the detection member is located at the advance position and the actuator is located at the detection position.

The light shielding part 96 is arranged at a left upper end portion of the actuator 92. The light shielding part 96 has a substantially flat plate shape extending in the upper-lower and left-right directions. The light shielding part 96 is positioned between the light emitting device and light receiving device of the optical sensor 91 when the actuator 92 is located at the non-detection position (FIG. 9B), and is retreated rightward from between the light emitting device and light receiving device of the optical sensor 91 when the actuator 92 is located at the detection position (FIG. 11A).

The control unit 93 has a circuit board having an application specific integrated circuit (ASIC) and is arranged in the apparatus main body 12. Also, the control unit 93 is configured to count the number of rotations of the developing roller 2.

5. Detection Operation

As shown in FIG. 2, when the process cartridge 13 having the developing cartridge 1 of which a maximum number of image formation sheets is 6,000 sheets is mounted to the apparatus main body 12 and the front cover 17 is closed, the main body coupling 90 (see FIG. 9B) in the apparatus main body 12 is fitted to the developing coupling 41 (see FIG. 9B) so that it cannot be relatively rotated, in accordance with the closing operation of the front cover 17.

After that, the control unit 93 starts a warm-up operation of the image forming apparatus 11.

When the warm-up operation of the image forming apparatus 11 starts, the engaging projections 90B of the main body coupling 90 are engaged with the protrusions 47A of the developing coupling 41.

Figure 10A:
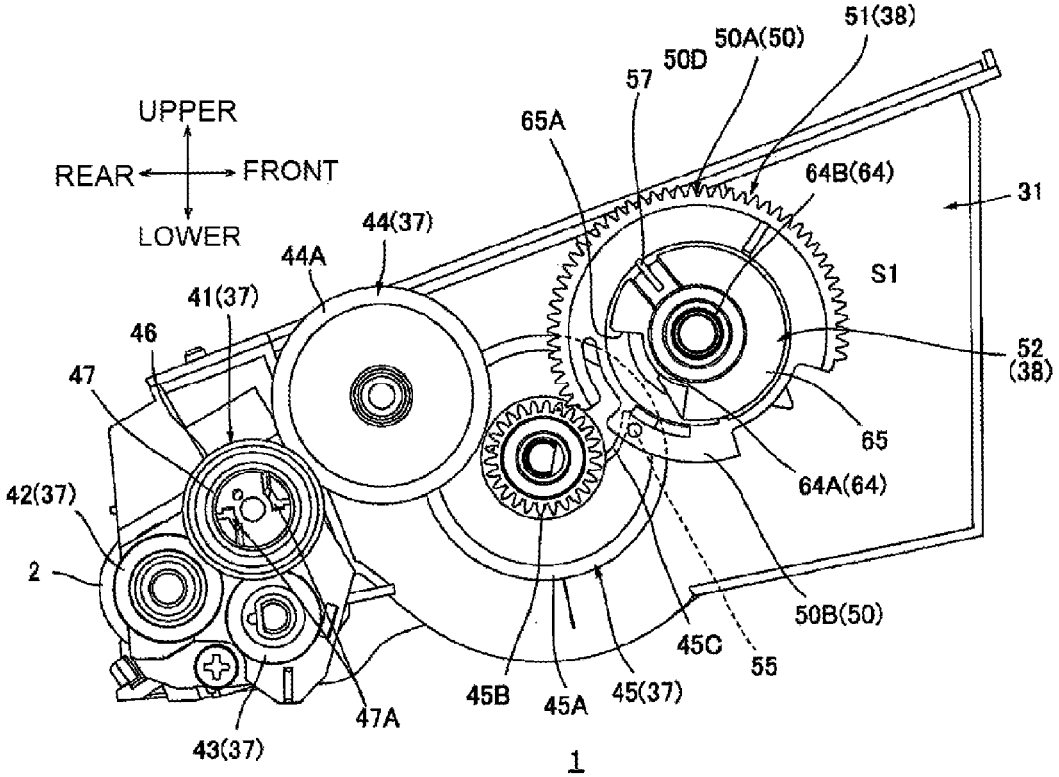
FIG. 10A illustrates a new product detection operation of the developing cartridge, which illustrates a state where an abutting rib of an agitator gear abuts on a boss of the toothless gear and a teeth part of the toothless gear is meshed with the agitator gear.

Then, a driving force is input from the apparatus main body 12 to the developing coupling 41 through the main body coupling 90, and the developing coupling 41 is rotated in the clockwise direction, as seen from the left side, as shown in FIG. 10A.

Then, the developing gear 42, the supply gear 43 and the idle gear 44 are rotated in the counterclockwise direction, as seen from a left side. Thereby, the developing roller 2 and the supply roller 3 are rotated in the counterclockwise direction, as seen from the left side.

Also, when the idle gear 44 is rotated, the agitator gear 45 is rotated in the clockwise direction, as seen from the left side. Thereby, the agitator 6 is rotated in the clockwise direction, as seen from the left side.

When the agitator gear 45 is rotated, the abutting rib 45C is moved in the clockwise direction, as seen from the left side, in accordance with the rotation of the agitator gear 45. Then, the abutting rib 45C abuts on the boss 55 of the toothless gear 51 from a rear-upper side, thereby pressing the boss 55 in a front-lower direction.

Thereby, the toothless gear 51 is rotated in the counterclockwise direction, as seen from the left side, and is meshed with the front upper end portion of the second gear part 45B of the agitator gear 45 at the gear teeth of the downstream end portion of the teeth part 50A in the counterclockwise direction, as seen from the left side. A position of the toothless gear 51 at that time is an example of the second position.

Then, the driving force is transmitted from the agitator gear 45 to the toothless gear 51, and the toothless gear 51 is rotated about a central axis A of the support shaft 36 of the toner cap 34 in the counterclockwise direction, as seen from the left side. Hereinafter, the counterclockwise direction as seen from the left side is referred to as a rotating direction R. The central axis A of the support shaft 36 of the toner cap 34 is an example of the rotational axis.

Then, the second slide part 56 of the toothless gear 51 abuts on the first inclined surface 40A of the displacement part 40 of the toner cap 34 from an upstream side in the rotating direction R.

Figure 10B:
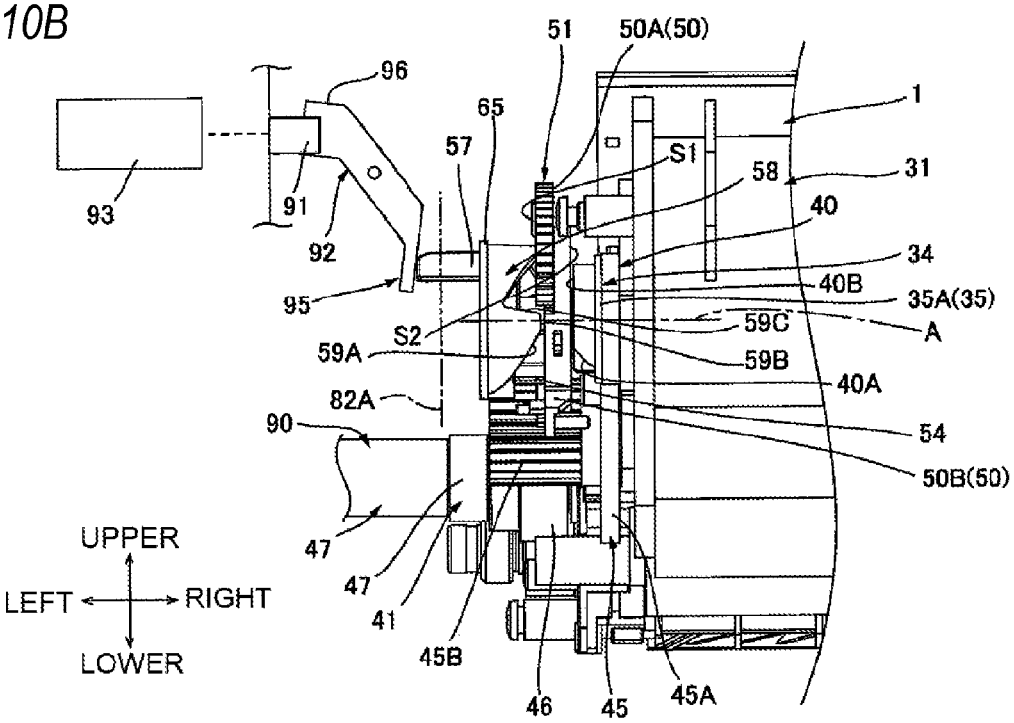
FIG. 10B illustrates the new product detection operation of the developing cartridge subsequent to FIG. 10A and is a front view of the developing cartridge illustrating a state where a first slide part of the toothless gear is sliding on a first inclined surface of a first displacement part of the detection member.

When the toothless gear 51 is further rotated, the toothless gear 51 rides on the displacement part 40 while sliding on the first inclined surface 40A in the rotating direction R at the second slide part 56. Thereby, the toothless gear 51 is gradually moved leftward to separate from the developing frame 31 against the urging force of the compression spring 63. When the second slide part 56 abuts on the parallel surface 40B, the toothless gear 51 is positioned at a spaced position more spaced from the developing frame 31 than the close position, as shown in FIG. 10B.

Also, the first slide part 54 of the toothless gear 51 abuts on the first inclined surface 59A of the first displacement part 59 of the detection member 52 from an upstream side in the rotating direction R.

Here, as described above, the left end portion of the detection projection 57 is arranged in the slit 71 (see FIG. 8) of the gear cover 39. Also, the engaging projections 64D (see FIG. 4C) of the detection member 52 are fitted in the guide recesses 74 (see FIG. 8).

Thereby, the left end portion of the detection projection 57 abuts on the peripheral edge part of the slit 71 at a downstream side in the rotating direction R and the engaging projections 64D abut on the inner surfaces of the guide recesses 74 in the rotating direction R, so that the detection projection 57 is restrained from being further rotated in the rotating direction R.

When the toothless gear 51 is further rotated, the first slide part 54 presses leftward the first inclined surface 59A of the first displacement part 59 while sliding along the first inclined surface 59A in the rotating direction R. Thereby, the detection member 52 is gradually moved leftward to separate from the developing frame 31 against the urging force of the compression spring 63 with the rotation thereof being restrained.

Then, the detection projection 57 is further advanced leftward through the slit 71, abuts on the pressed part 95 of the actuator 92 from right, and presses leftward the pressed part 95. Thereby, the actuator 92 swings from the non-detection position in the clockwise direction, as seen from the front side.

Figure 12:
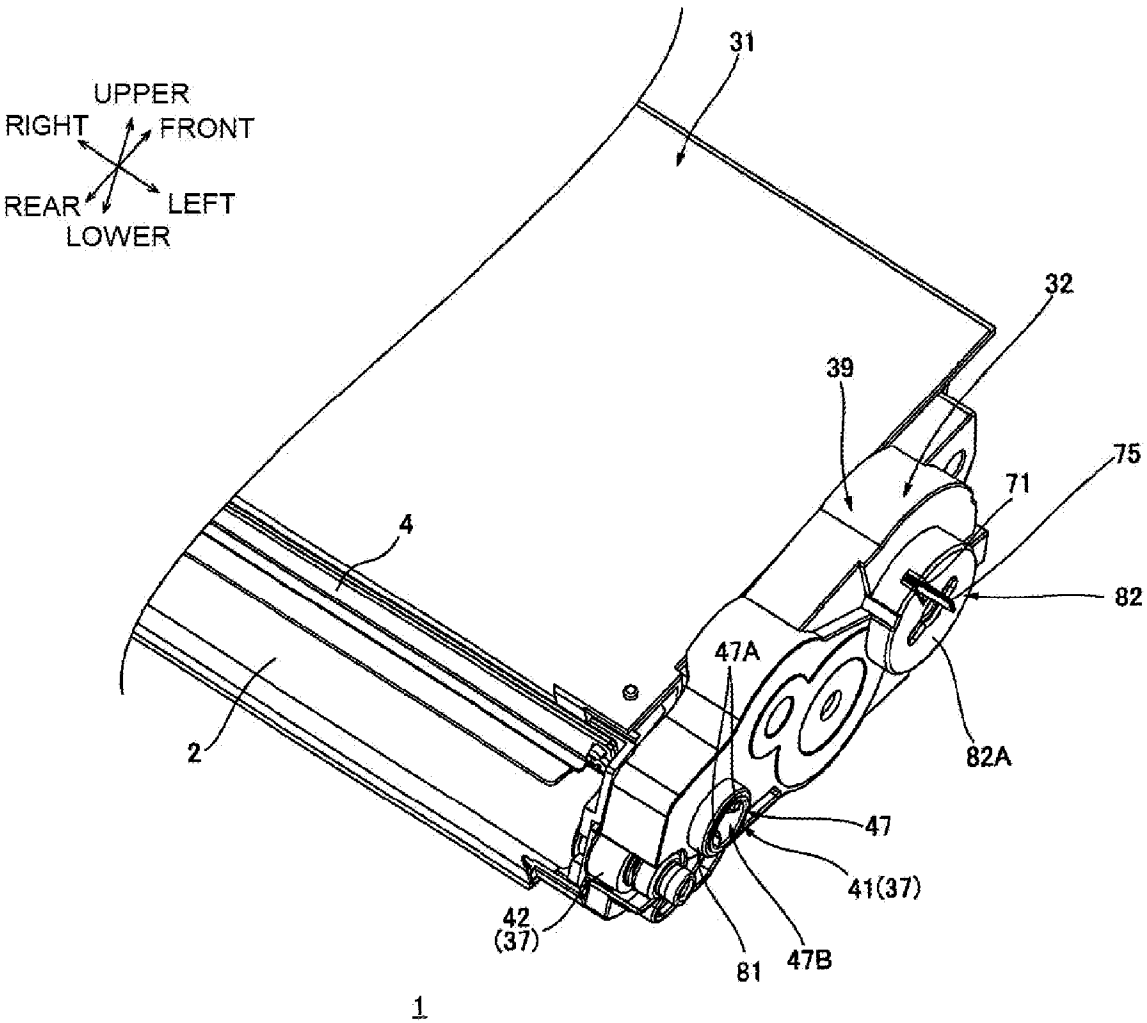
FIG. 12 is a perspective view of the developing cartridge at the state shown in FIG. 11A, as seen from a left-rear side.

Then, when the toothless gear 51 is further rotated, as shown in FIGS. 11A and 12, the detection member 52 is located at the advance position at which the detection projection 57 is advanced most leftward when the first slide part 54 abuts on the first parallel surface 59B of the first displacement part 59.

At this time, the actuator 92 is located at the detection position. The light shielding part 96 is retreated rightward between the light emitting device and light receiving device of the optical sensor 91. Thereby, the light receiving device of the optical sensor 91 receives the detection light, and the optical sensor 91 outputs a first light receiving signal.

Then, the control unit 93 determines that the unused developing cartridge 1 has been mounted to the apparatus main body 12, because the light receiving signal is received from the optical sensor 91 within predetermined time after the warm-up operation starts. Thereby, the control unit 93 resets the counted number of rotations of the developing roller 2.

Then, when the toothless gear 51 is further rotated, the first slide part 54 abuts on the second inclined surface 59C of the first displacement part 59 and slides along the second inclined surface 59C in the rotating direction R. Then, the detection member 52 is gradually moved rightward to come close to the developing frame 31 by the urging force of the compression spring 63 while being restrained from rotating.

Thereby, the detection projection 57 is gradually retreated into the gear cover 39 and is spaced leftward from the pressed part 95 of the actuator 92. Then, the actuator 92 swings from the detection position in the clockwise direction, as seen from the front, side and is located at the non-detection position. At this time, the second slide part 56 is still sliding on the displacement part 40.

Thereby, the light shielding part 96 of the actuator 92 is positioned between the light emitting device and light receiving device of the optical sensor 91.

Thus, the light receiving device of the optical sensor 91 does not receive the detection light and the optical sensor 91 stops the output of the first light receiving signal.

Then, when the toothless gear 51 is further rotated, the further movement of the detection member 52 in the rightward direction is stopped at a state where the detection projection 57 is advanced more leftward than the gear cover 39 when the first slide part 54 abuts on the second parallel surface 59D of the first displacement part 59, as shown in FIG. 11B. Thereby, the first reciprocating movement of the detection member 52 is completed.

Then, when the toothless gear 51 is further rotated, the first slide part 54 abuts on the second displacement part 60 and presses leftward the first inclined surface 60A, like the first displacement part 59, as shown in FIG. 11C. Thereby, the detection member 52 is located at the advance position, like the case where the first slide part 54 abuts on the first displacement part 59. Thereafter, the detection member 52 is retreated rightward. Thereby, the second time reciprocating movement of the detection member 52 is completed. Also, the optical sensor 91 outputs a second time light receiving signal and then stops the output of the second time light receiving signal.

Then, when the toothless gear 51 is further rotated, the first slide part 54 abuts on the third displacement part 61 and presses leftward the first inclined surface 61A, like the second displacement part 60. Thereby, the detection member 52 is located at the advance position, like the case where the first slide part 54 abuts on the second displacement part 60. Thereafter, the detection member 52 is retreated rightward. Thereby, the third time reciprocating movement of the detection member 52 is completed. Also, the optical sensor 91 outputs a third time light receiving signal and then stops the output of the third time light receiving signal.

Figure 13A:
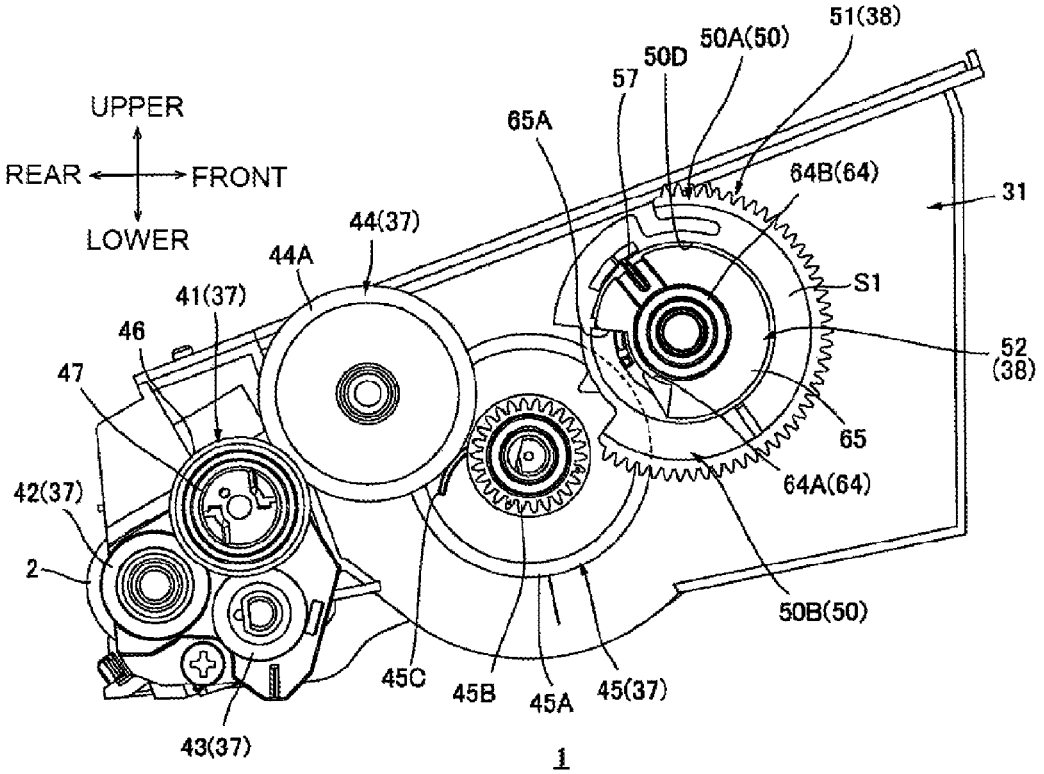
FIG. 13A illustrates the new product detection operation of the developing cartridge subsequent to FIG. 11C, which illustrates a state where the meshing between the teeth part of the toothless gear and the agitator gear is released.
Figure 13B:
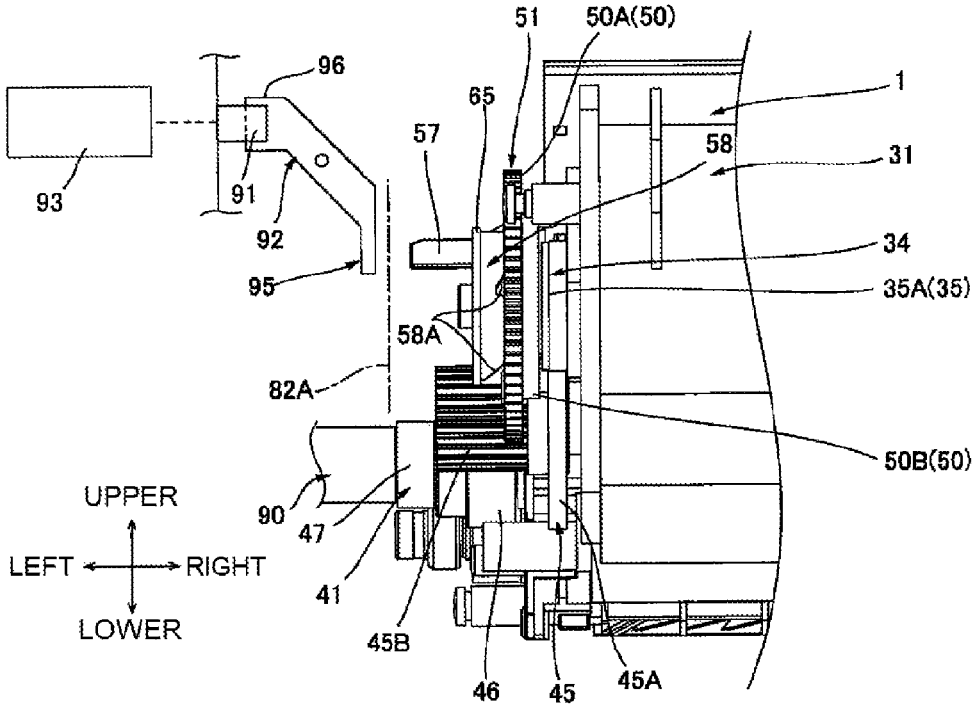
FIG. 13B is a front view of the developing cartridge shown in FIG. 13A, which illustrates a state where the detection member is located at a retreat position and the actuator is located at the non-detection position.

Then, when the toothless gear 51 is further rotated, the toothless gear 51 is stopped as the teeth part 50A of the toothless gear 51 separates from the second gear part 45B of the agitator gear 45, as shown in FIGS. 13A and 13B. In the meantime, at this time, referring to FIG. SA, the toothless gear 51 is located at the close position as the second slide part 56 slides along the second inclined surface 40C of the displacement part 40 and is arranged between the second inclined surface 40C and the second stopper 34B due to the urging force of the compression spring 63.

Here, the number of receiving times of the light receiving signal, which is received from the optical sensor 91 by the control unit 93 within a predetermined time after the warm-up operation starts, is associated with the specification (specifically, the maximum number of image formation sheets) of the developing cartridge 1. For example, as described above, when the light receiving signal is received three times, the control unit 93 determines that the developing cartridge 1 of a first specification (maximum number of image formation sheets: 6,000 sheets) has been mounted to the apparatus main body 12. Also, when the light receiving signal is received one time, the control unit 93 determines that the developing cartridge 1 of a second specification (maximum number of image formation sheets: 3,000 sheets) has been mounted to the apparatus main body 12.

Thereafter, when the predetermined time elapses, the control unit 93 ends the warm-up operation.

On the other hand, when the light receiving signal is not received from the optical sensor 91 within the predetermined time after the warm-up operation starts, the control unit 93 determines that the developing cartridge 1 used or being used is mounted to the apparatus main body 12.

6. Operational Effects (1) According to the developing cartridge 1, the toothless gear 51 has the first slide part 54 on the left surface S1 facing the detection member 52 and the second slide part 56 on the right surface S2 facing the toner cap 34 of the developing frame 31. The toothless gear 51 can move the toothless gear 51 itself leftward by the second slide part 56 and move the detection member 52 leftward by the first slide part 54.

For this reason, as compared to a configuration where the detection member 52 is moved by one operating part, it is possible to largely move the detection member 52 leftward, and to stably bring the detection projection 57 into contact with the actuator 92 of the apparatus main body 12.

As a result, it is possible to enable the apparatus main body 12 to recognize that the unused developing cartridge 1 has been mounted.

Also, it is considered to reduce the diameter of the toothless gear 51 so as to make the developing cartridge 1 small.

In this case, when it is intended to secure a movement distance of the detection member 52 in the left-right direction while reducing the diameter of the toothless gear 51, if there is one operating part, it is necessary to provide the detection member 52 with an inclined surface largely inclined in the left-right direction in the rotating direction so as to secure the movement distance of the detection member 52 in the left-right direction. When the inclined surface is largely inclined, it may be difficult to smoothly move the detection member 52.

However, according to the developing cartridge 1, the first slide part 54 facing the detection member 52 and the second slide part 56 facing the toner cap 34 of the developing frame 31 are provided.

Also, the toner cap 34 has the displacement part 40, and the detection member 52 has the displacement part 58.

For this reason, as compared to a configuration where there is one operating part, it is possible to gently keep the respective inclinations of the two displacement parts, i.e., the displacement part 40 of the toner cap 34 and the displacement part 58 of the detection member 52.

As a result, it is possible to secure the movement distance of the detection member 52 in the left-right direction and to smoothly move the detection member 52.

(2) According to the developing cartridge 1, as shown in FIG. 1, in the configuration where the developing roller 2 is provided, it is possible to protect the detection member 52 and to stably bring the detection projection 57 into contact with the actuator 92.

(3) According to the developing cartridge 1, as shown in FIG. 6B, the second slide part 56 is arranged at the diametrically inner side of the first slide part 54 corresponding to the displacement part 58 of the detection member 52, in correspondence to the displacement part 40 of the toner cap 34.

For this reason, as shown in FIGS. 6A and 9A, it is possible to arrange the displacement part 58 of the detection member 52 and the displacement part 40 of the toner cap 34 to be deviated from each other in the diametrical direction and to also effectively arrange the first slide part 54 and the second slide part 56 to be deviated from each other in the diametrical direction.

Thereby, it is possible to make the size smaller in the left-right direction, as compared to a configuration where the displacement part 40 of the toner cap 34 and the displacement part 58 of the detection member 52 are arranged at the same positions in the diametrical direction and the first slide part 54 and the second slide part 56 are arranged at the same positions in the diametrical direction.

(4) According to the developing cartridge 1, the detection member 52 has the displacement part 58 on which the first slide part 54 abuts, and the toner cap 34 of the developing frame 31 has the displacement part 40 on which the second slide part 56 abuts.

For this reason, with the simple configuration, it is possible to abut the first slide part 54 on the displacement part 58 of the detection member 52 to thus move the detection member 52 leftward, and to abut the second slide part 56 on the displacement part 40 of the toner cap 34 to thus move the toothless gear 51 leftward.

As a result, it is possible to largely move the detection member 52 leftward by the simple configuration.

(5) According to the developing cartridge 1, it is possible to smoothly move the detection member 52 leftward by the first inclined surface 59A of the displacement part 58 of the detection member 52, and to smoothly move the toothless gear 51 leftward by the first inclined surface 40A of the displacement part 40 of the toner cap 34.

As a result, it is possible to smoothly move the detection member 52 leftward, and to stably bring the detection projection 57 into contact with the actuator 92.

(6) According to the developing cartridge 1, as shown in FIGS. 11A and 11C, when the first slide part 54 abuts on the first parallel surface 59B of the first displacement part 59 or the first parallel surface 60B of the second displacement part 60, the detection member 52 is most spaced leftward from the left surface S1 of the toothless gear 51. Also, when the second slide part 56 abuts on the parallel surface 40B of the displacement part 40, the toothless gear 51 is most spaced leftward from the developing frame 31.

For this reason, when the toothless gear 51 is arranged at the maximum movement position at which the first slide part 54 abuts on the first parallel surface 59B of the first displacement part 59 or the first parallel surface 60B of the second displacement part 60 in a state where the second slide part 56 abuts on the parallel surface 40B of the displacement part 40, the detection member 52 can be advanced most leftward from the developing frame 31.

As a result, when the toothless gear 51 is arranged at the maximum movement position, it is possible to abut the detection member 52 on the actuator 92 more stably.

(7) According to the developing cartridge 1, as shown in FIG. 9B, when the developing cartridge 1 is not in use and the detection member 52 is not detected by the configuration of the apparatus main body 12, the detection member 52 can be covered with the left wall 82A of the detection member accommodation part 82 of the gear cover 39, so that it is possible to reliably prevent an interference with a surrounding member.

(8) According to the developing cartridge 1, as shown in FIG. 3A, it is possible to reliably retreat the detection member 52 rightward by the urging force of the compression spring 63.

Figure 8:
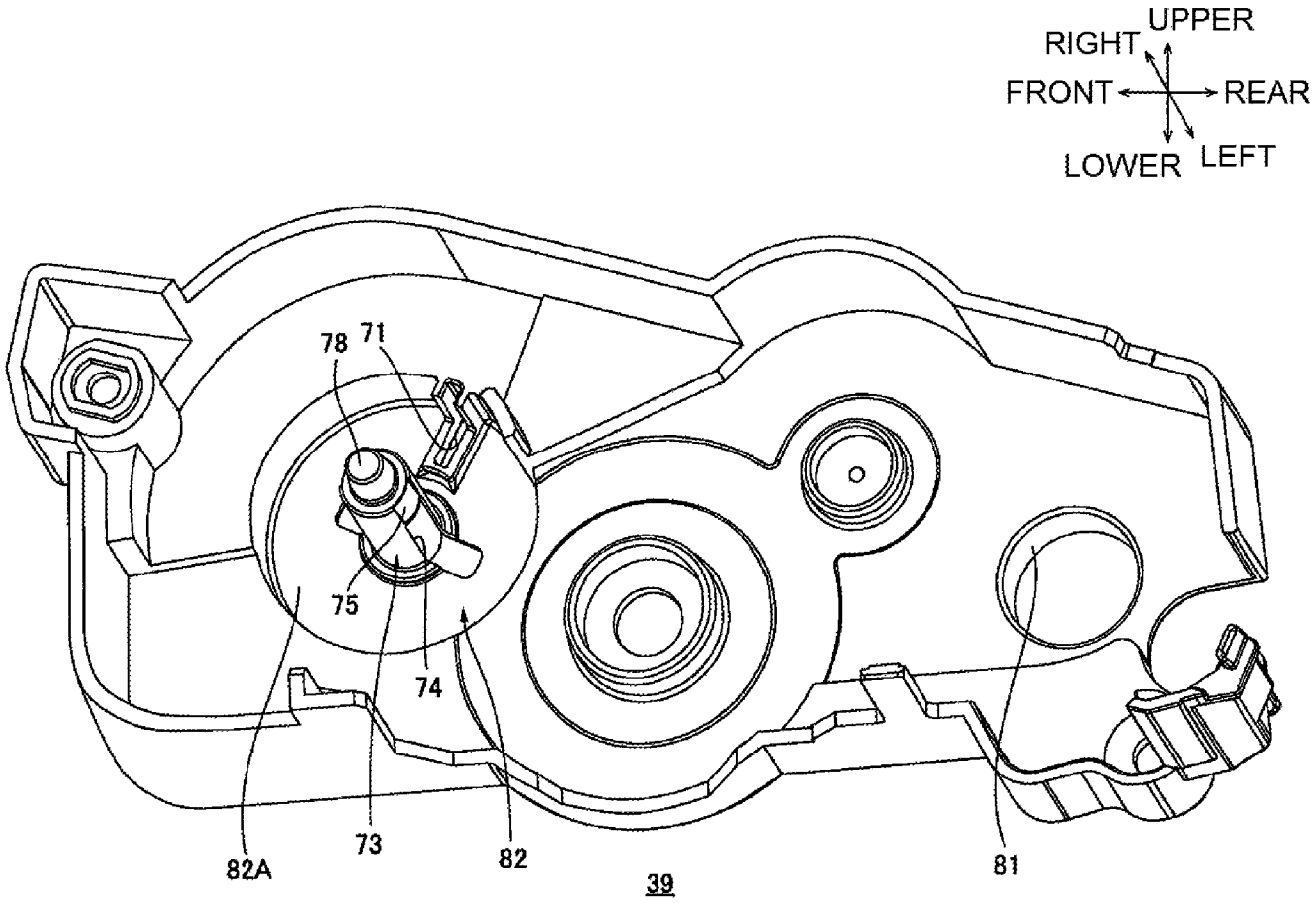
FIG. 8 is a perspective view of a gear cover shown in FIG. 1, as seen from a right-lower side.

(9) According to the developing cartridge 1, as shown in FIGS. 4 and 8, the gear cover 39 has the support shaft 73 that supports the detection member 52, and the toner cap 34 has the support shaft 36 that supports the toothless gear 51.

For this reason, it is possible to support the toothless gear 51 and the detection member 52 by using the gear cover 39 and the toner cap 34 while reducing the number of components.

(10) According to the developing cartridge 1, it is possible to operate the developing cartridge 1 with the toothless gear 51 being stopped after the driving force is input from the apparatus main body 12 to the developing coupling 41 and until the abutting rib 45C of the agitator gear 45 abuts on the boss 55 of the toothless gear 51, as shown in FIG. 10A.

Thereafter, the abutting rib 45C of the agitator gear 45 abuts on the boss 55 of the toothless gear 51, so that it is possible to transmit the driving force from the agitator gear 45 to the toothless gear 51.

Thereby, after the developing cartridge 1 operates stably, the driving force is transmitted from the agitator gear 45 to the toothless gear 51, thereby moving the detection member 52.

As a result, it is possible to enable the apparatus main body 12 to detect the detection member 52 while the developing cartridge 1 is stably operating.

(11) According to the developing cartridge 1, as shown in FIG. 3B, the front end portion of the agitator gear 45 is positioned in the notched portion 65A of the detection member 52, when projected in the left-right direction.

For this reason, it is possible to closely arrange the detection member 52 and the agitator gear 45 in the left-right direction.

As a result, it is possible to make the developing cartridge 1 small.

(12) According to the developing cartridge 1, as shown in FIGS. 9B, 11A and 11B, the detection member 52 is moved only in the left-right direction while being restrained from rotating.

For this reason, as compared to a configuration where the detection member 52 is rotated, it is possible to save a moving trajectory space of the detection member 52.

7. Modified Embodiments

(1) First Modified Embodiment

In the above illustrative embodiment, the detection member 52 is provided with the displacement part 58, and the toothless gear 51 is provided with the first slide part 54. Also, the toner cap 34 is provided with the displacement part 40, and the toothless gear 51 is provided with the second slide part 56.

Figure 14:
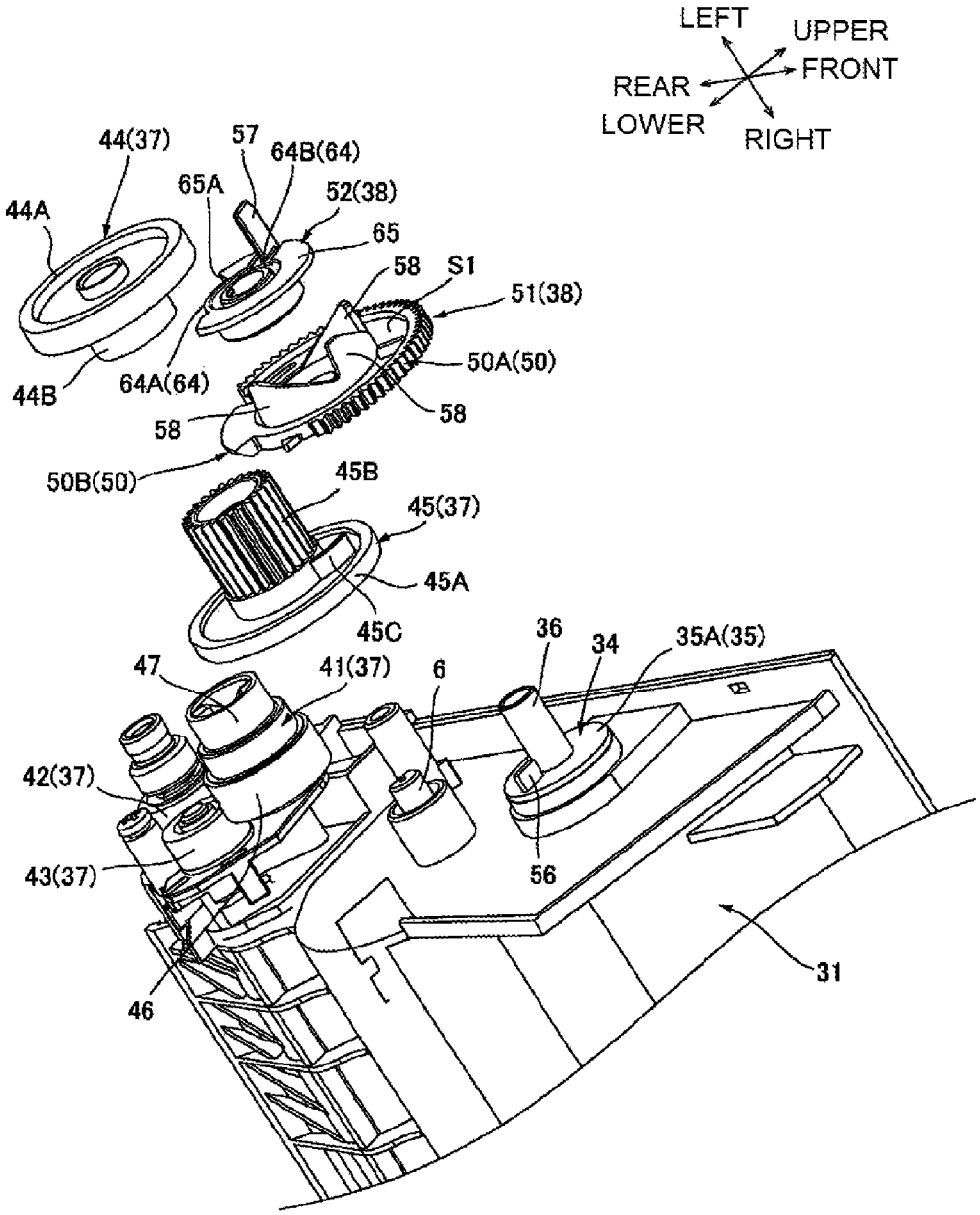
FIG. 14 is an exploded perspective view of a first modified embodiment of the developing cartridge, as seen from a left-lower side.
Figure 15A:
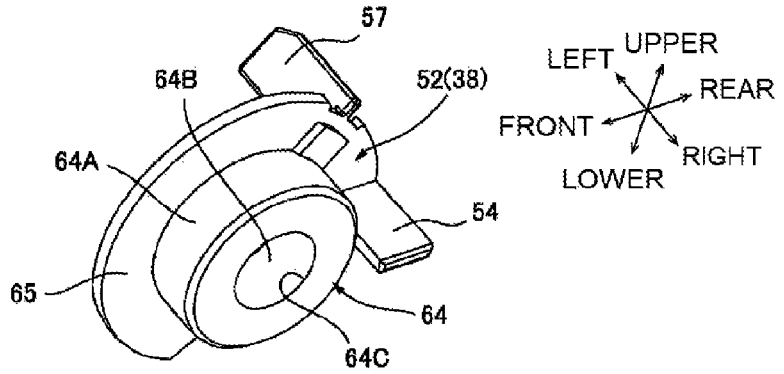
FIG. 15A is a perspective view of the detection member shown in FIG. 14, as seen from a right-front side.
Figure 15B:
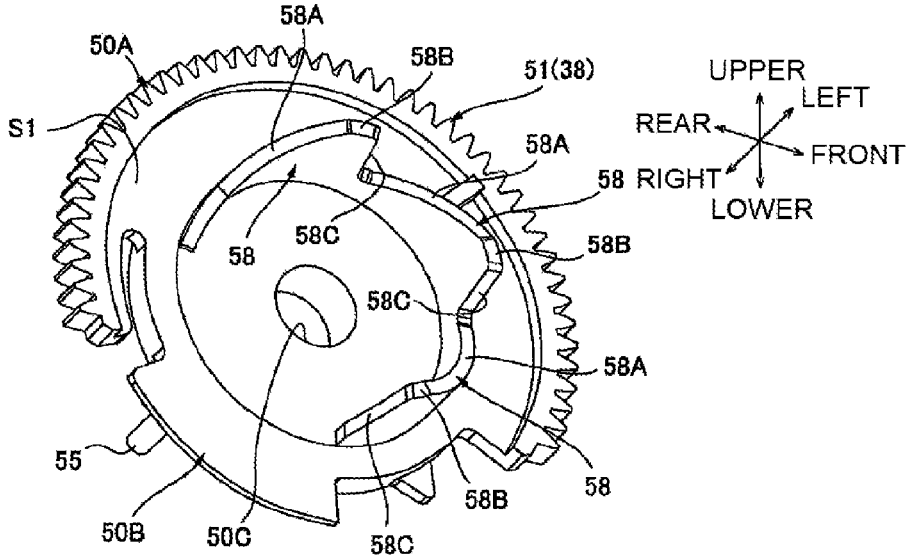
FIG. 15B is a perspective view of the toothless gear shown in FIG. 14, as seen from a left-lower side.

However, as shown in FIGS. 14, 15A and 15B, the detection member 52 may be provided with the first slide part 54, and the left surface S1 of the toothless gear 51 may be provided with the displacement part 58.

Figure 15C:
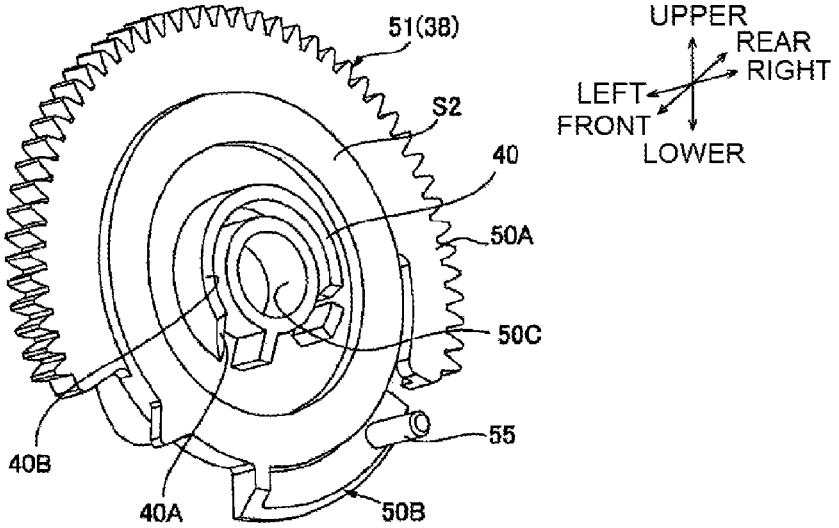
FIG. 15C is a perspective view of the toothless gear shown in FIG. 14, as seen from a right-front side.

Also, as shown in FIGS. 14 and 15, the toner cap 34 may be provided with the second slide part 56, and the right surface S2 of the toothless gear 51 may be provided with the displacement part 40.

Also, the detection member 52 may be provided with the displacement part 58, and the right surface S2 of the toothless gear 51 may be provided with the displacement part 40.

Also, the toner cap 34 may be provided with the displacement part 40, and the left surface S1 of the toothless gear 51 may be provided with the displacement part 58.

Also, the displacement part 40 may be provided to the developing frame 31, instead of the toner cap 34.

Also in the first modified embodiment, it is possible to accomplish the same operational effects as the above illustrative embodiment.

(2) Second Modified Embodiment

Figure 16A:
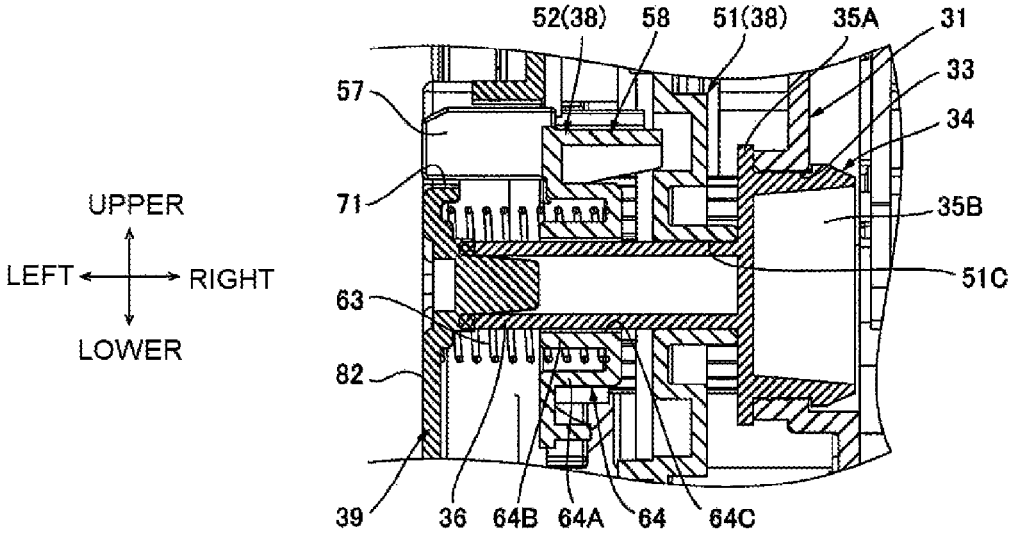
FIG. 16A illustrates a second modified embodiment of the developing cartridge.

In the above illustrative embodiment, the support shaft 36 of the toner cap 34 supports the toothless gear 51, and the support shaft 73 of the gear cover 39 supports the detection member 52. However, as shown in FIG. 16A, the gear cover 39 may not be provided with the support shaft 73 and the support shaft 36 of the toner cap 34 may be elongated in the left-right direction to support the toothless gear 51 and the detection member 52 to the support shaft 36 of the toner cap 34.

Also in the second modified embodiment, it is possible to accomplish the same operational effects as the above illustrative embodiment.

(3) Third Modified Embodiment

Figure 16B:
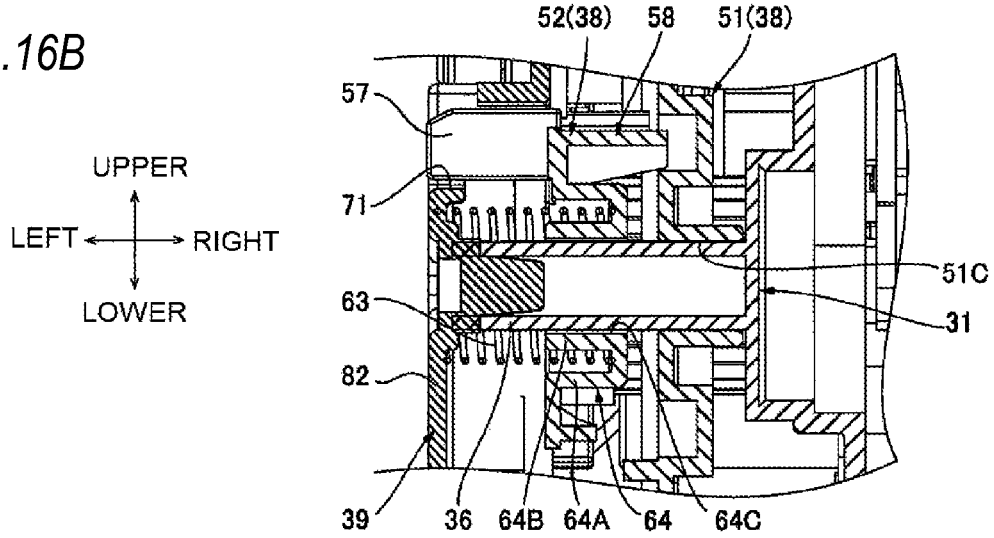
FIG. 16B illustrates a third modified embodiment of the developing cartridge.

In the second modified embodiment, the toner cap 34 is provided with the support shaft 36. However, as shown in FIG. 16B, the support shaft 36 may be provided on the left wall of the developing frame 31.

Also in the third modified embodiment, it is possible to accomplish the same operational effects as the above illustrative embodiment.

(4) Fourth Modified Embodiment

Figure 16C:
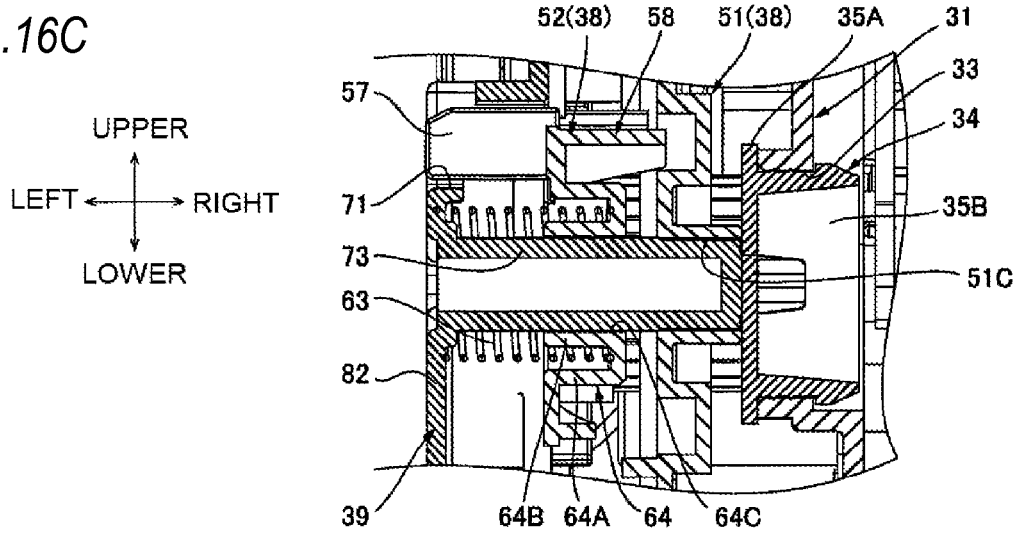
FIG. 16C illustrates a fourth modified embodiment of the developing cartridge.

Also, as shown in FIG. 16C, the toner cap 34 may not be provided with the support shaft 36 and the gear cover 39 may be configured with the support shaft 73 elongated in the left-right direction to support the toothless gear 51 and the detection member 52 to the support shaft 73 of the gear cover 39.

Also, in this case, the support shaft 73 provided to the gear cover 39 may be supported with the developing frame 31, instead of the toner cap 34.

Also in the fourth modified embodiment, it is possible to accomplish the same operational effects as the above illustrative embodiment.

(5) Fifth Modified Embodiment

In the above illustrative embodiment, the toothless gear 51 has been exemplified as the rotary member, and the agitator gear 45 has been exemplified as the transmission member. However, the rotary member and the transmission member are not limited to the gear. For example, the rotary member and the transmission member may be configured by friction wheels having no gear teeth.

Figure 17:
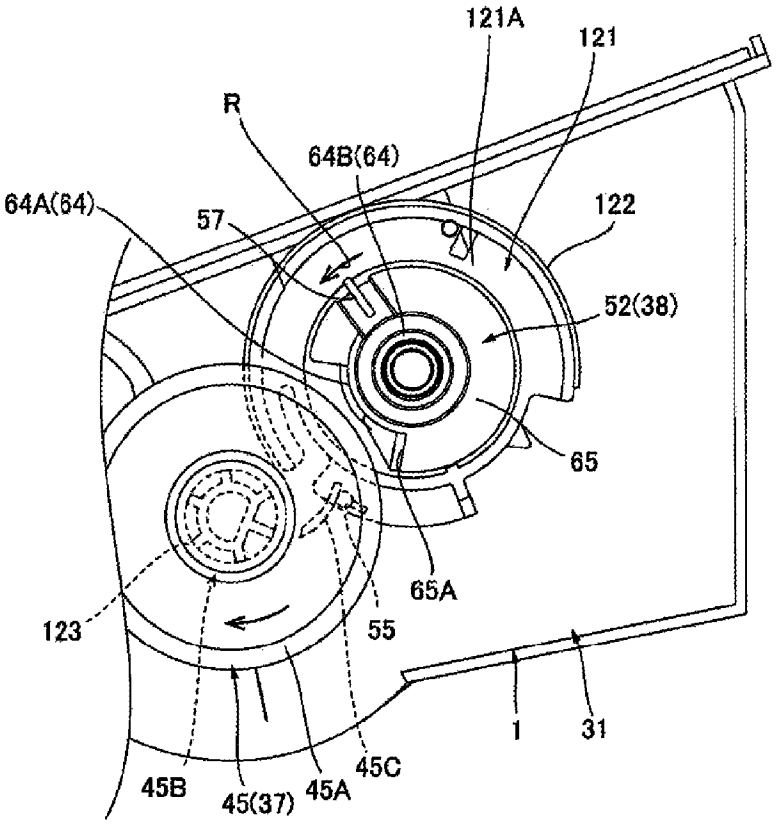
FIG. 17 illustrates a fifth modified embodiment of the developing cartridge.
Figure 17:
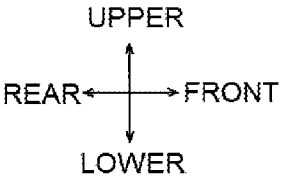

Specifically, as shown in FIG. 17, the second gear part 45B of the agitator gear 45 may be provided with a first resistance applying member 123 of which at least an outer peripheral surface is configured by a material having a relatively large friction coefficient such as rubber, instead of the gear teeth, a transmitted part 121A of a rotary member 121 may be provided with a second resistance applying member 122 of which at least an outer peripheral surface is configured by a material having a relatively large friction coefficient such as rubber, instead of the gear teeth, and the driving force may be transmitted through friction between the resistance applying members.

Also, in this case, the second gear part 45B of the agitator gear 45 may be configured by the gear teeth and only the transmitted part 121A of the rotary member 121 may be provided with the second resistance applying member 122 of which the outer peripheral surface is configured by the material having a relatively large friction coefficient such as rubber.

Also in the fifth modified embodiment, it is possible to accomplish the same operational effects as the above illustrative embodiment.

(6) Sixth Modified Embodiment

Figure 18A:
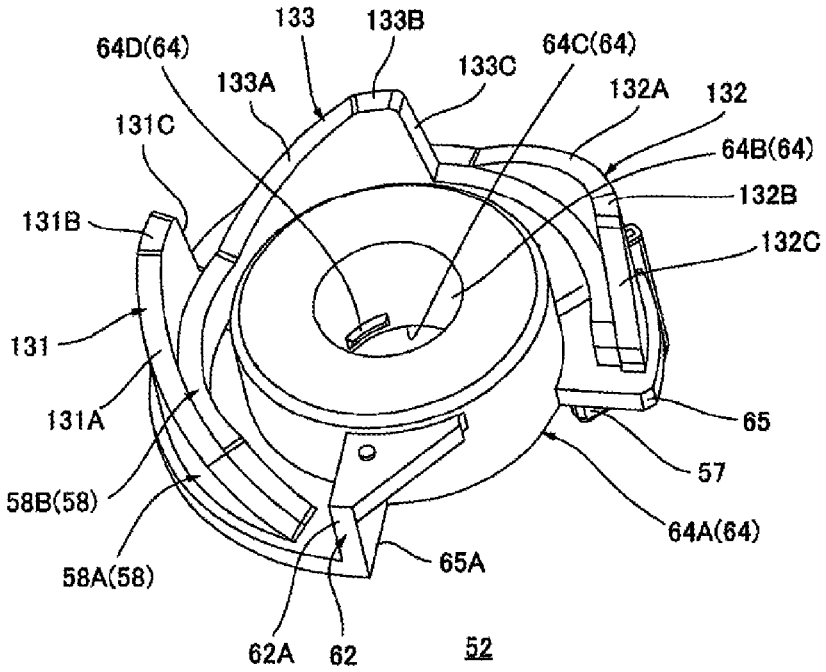
FIG. 18A illustrates a sixth modified embodiment of the developing cartridge, as seen from a right-lower side.
Figure 18B:
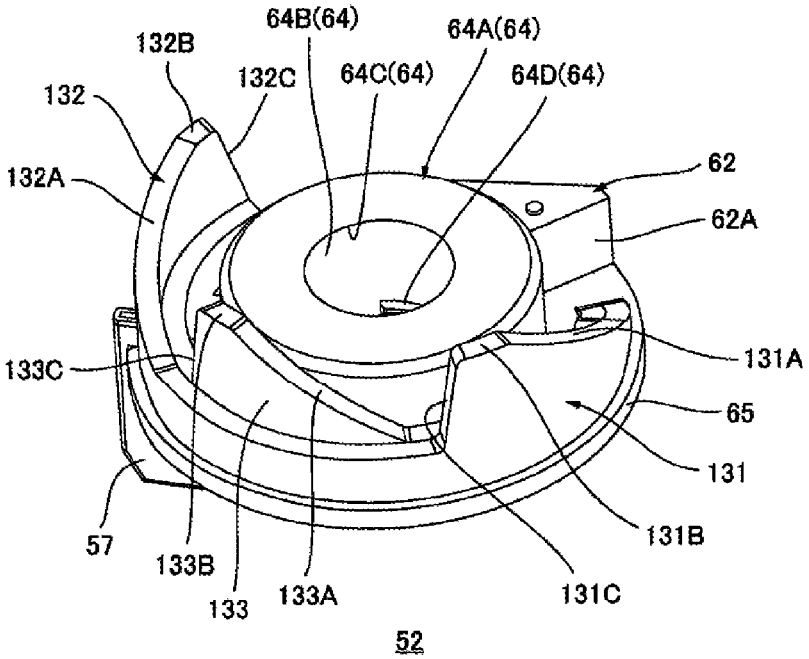
FIG. 18B illustrates the sixth modified embodiment of the developing cartridge, as seen from a right-front side.

In the above illustrative embodiment, the one displacement part 58 of the detection member 52 is provided with the first displacement part 59, the second displacement part 60 and the third displacement part 61. However, for example, as shown in FIGS. 18A and 18B, two displacement parts 58 may be arranged to overlap with each other in the diametrical direction of the detection member 52 and the diametrically outer-side displacement part 58A in the diametrical direction and the diametrically inner-side displacement part 58B may be provided with any one of a first displacement part 131, a second displacement part 133 and a third displacement part 132, respectively. That is, the first displacement part 131, the second displacement part 133 and the third displacement part 132 may be arranged to deviate each other in the diametrical direction of the detection member 52.

Specifically, the diametrically outer-side displacement part 58A may be provided with the first displacement part 131 and the third displacement part 132, and the diametrically inner-side displacement part 58B may be provided with the second displacement part 133.

Also in the sixth modified embodiment, it is possible to accomplish the same operational effects as the above illustrative embodiment.

(7) Other Modified Embodiments

In the above illustrative embodiment, the developing coupling 41 has been exemplified as the driving receiving part. However, the driving receiving part is not limited to the shaft coupling such as the developing coupling 41 and may be a gear, for example.

Also, in the above illustrative embodiment, the developing cartridge 1 having the developing roller 2 has been exemplified as the cartridge. However, the cartridge may be configured by a toner cartridge having only the toner accommodation part 5, without the developing roller 2 and the supply roller 3, for example.

Also, in the above illustrative embodiment, the developing roller 2 has been exemplified as the developer carrier. However, for example, a developing sleeve and the like may also be applied as the developer carrier.

Also, in the above illustrative embodiment, the agitator gear 45 supported to the rotary shaft of the agitator 6 has been exemplified as the transmission member. However, the transmission member may be configured by an idle gear, which is not coupled to the rotary shaft of the agitator 6 and is supported to the left wall of the developing frame 31.

Also, in the above illustrative embodiment, the compression spring 63 has been exemplified as the urging member. However, a shape of the urging member is not limited to the coil shape, and a plate spring and the like may also be applied, for example.

Also, in the above illustrative embodiment, the toothless gear 51 has been configured as one member. However, the shape of the toothless gear 51 is not particularly limited. For example, a toothless gear having the first slide part 54 and a toothless gear having the second slide part 56 may be arranged to overlap with each other in the left-right direction and the toothless gears may be meshed with each other so that they cannot be relatively rotated.

Also, in the above illustrative embodiment, the detection member is moved from the retreat position to the advance position and is then reciprocally moved between the standby position and the advance position. That is, the movement distance of the detection member 52 during the second and thereafter advancing operations is shorter than the movement distance of the detection member 52 during the first advancing operation.

However, the movement distances of the detection member 52 during the respective advancing operations may be the same or may be all different.

Also, during one advancing and retreating operation, the movement distance of the detection member 52 during the advancing operation and the movement distance of the detection member 52 during the retreating operation may be the same or different.

Also, in the above illustrative embodiment, the detection projection 57 is completely accommodated in the gear cover 39 at the state where the detection member 52 is located at the accommodation position. However, the detection projection 57 may slightly protrude from the gear cover 39 at the state where the detection member 52 is located at the accommodation position.

Also, in the above illustrative embodiment, both sidewalls of the developing frame 31 in the left-right direction extend in the front-rear direction, respectively. However, at least one of both sidewalls of the developing frame 31 in the left-right direction may be inclined relative to the front-rear direction.

Also, in the above illustrative embodiment, when the light receiving signal is received three times, it is determined that the developing cartridge 1 of which the maximum number of image formation sheets is 6,000 sheets has been mounted, and when the light receiving signal is received one time, it is determined that the developing cartridge 1 of which the maximum number of image formation sheets is 3,000 sheets has been mounted. However, the relation between the detection member 52 and the maximum number of image formation sheets is not particularly limited and may be appropriately set, provided that the specification of the developing cartridge 1 can be distinguished.

For example, when the light receiving signal is received three times, it may be determined that the maximum number of image formation sheets is 3,000 sheets, and when the light receiving signal is received one time, it may be determined that the maximum number of image formation sheets is 6,000 sheets.

Also, the numerical values of the maximum number of image formation sheets are not limited to the above numerical values and may be appropriately set. For example, when the light receiving signal is received three times, it may be determined that the maximum number of image formation sheets is 1,000 sheets, and when the light receiving signal is received one time, it may be determined that the maximum number of image formation sheets is 2,000 sheets.

Also, in the above illustrative embodiment, the idle gear support shaft 30 is integrally provided to the developing frame 31. However, the idle gear support shaft 30 may be configured as a separate member from the developing frame 31.

Also, in the above illustrative embodiment, the support shaft (not shown) that supports the developing coupling 41 is integrally provided to the developing frame 31. However, the support shaft (not shown) that supports the developing coupling 41 may be configured as a separate member from the developing frame 31.

Also, in the above illustrative embodiment, the control unit 93 counts the number of rotations of the developing roller 2. However, for example, the control unit 93 may count the number of rotations of the agitator 6 or to measure a remaining amount of toner in the toner accommodation part 5. In this case, the control unit 93 resets the number of rotations of the agitator 6 or the measured value of the remaining amount of toner in the toner accommodation part 5 when it is determined that an unused (new product) developing cartridge 1 has been mounted.

The above illustrative embodiment and modified embodiments may be combined with each other.

The disclosure provides illustrative, non-limiting aspects as follows:

According to an aspect of the disclosure there is provided a cartridge including: a housing configured to accommodate therein developer; a driving receiving part configured to receive a driving force; a rotary member configured to rotate by receiving a driving force from the driving receiving part and move in an axis direction, which is parallel with a rotational axis of the rotary member, while rotating; and a detected member configured to move in the axis direction by receiving a driving force from the rotary member, wherein the rotary member includes: a main body part having a first surface facing the detected member in the axis direction and a second surface positioned at an opposite side of the first surface in the axis direction, an operating part arranged on the first surface and configured to apply a force for moving the detected member in the axis direction to the detected member, and an operated part arranged on the second surface and configured to receive a force for moving the main body part in the axis direction.

According to the above configuration, the rotary member includes the operating part on the first surface facing the detected member and the operated part on the second surface facing the housing. The rotary member can move the rotary member itself to the outer side in the axis direction by the operated part and move the detected part to the outer side in the axis direction by the operating part.

As a result, it is possible to enable the external device to recognize that an unused cartridge has been mounted.

Also, as compared to a configuration where the detected member is moved by one operating part, it is possible to largely move the detected member in the axis direction, so that it is possible to enable the external device to stably detect the detected member.

The above cartridge may further include a developer carrier configured to carry thereon the developer.

According to the above configuration, in a configuration where the developer carrier is provided, it is possible to protect the detected member and to enable the external device to stably detect the detected member.

In the above cartridge, the operating part and the operated part may be arranged at different positions in a diametrical direction orthogonal to the rotational axis.

According to the above configuration, it is possible to effectively arrange the operating part and the operated part.

Thereby, it is possible to make a size small in the axis direction.

In the above cartridge, the detected member may include a first abutment part on which the operating part abuts. The housing may include a second abutment part on which the operated part abuts.

According to the above configuration, it is possible to abut the operating part on the first abutment part and abut the operated part on the second abutment part, thereby moving the detected member with a simple configuration.

In the above cartridge, at least one of the operating part and the first abutment part may include a first inclined part, which is inclined in a direction coming close to the first surface toward a downstream side in a rotating direction of the rotary member. At least one of the operated part and the second abutment part may include a second inclined part, which is inclined in a direction coming close to the second surface toward the downstream side in the rotating direction of the rotary member.

According to the above configuration, it is possible to smoothly move the detected member in the axis direction by the first inclined part and to smoothly move the rotary member in the axis direction by the second inclined part.

As a result, it is possible to smoothly move the detected member in the axis direction and to enable the external device to stably detect the detected member.

In the above cartridge, the rotary member may be configured such that, during the rotation of the rotary member, the operating part abuts on a portion of the first abutment part that is closest to the first surface and the operated part abuts on a portion of the second abutment part that is closest to the second surface at the same time.

According to the above configuration, when the rotary member is arranged at a maximum movement position, the operating part abuts on the portion of the first abutment part closest to the first surface, so that the detected member is most spaced from the first surface of the rotary member. Also, the operated part abuts on the portion of the second abutment part closest to the second surface, so that the rotary member is most spaced from the housing.

For this reason, when the rotary member is arranged at the maximum movement position, it is possible to enable the detected member to advance to the outermost from the housing in the axis direction.

As a result, when the rotary member is arranged at the maximum movement position, it is possible to enable the external device to further stably detect the detected member.

The above cartridge may further include a covering member including a covering part that faces the detected member from an opposite side of the rotary member in the axis direction.

According to the above configuration, when the detected member is not detected by the external device, the detected member is covered by the covering part, so that it is possible to reliably prevent interference between the detected member and a surrounding member.

The above cartridge may further include an urging member abutting on the covering part and the detected member and configured to urge the detected member toward the rotary member.

According to the above configuration, it is possible to reliably retreat the detected member in the direction from the covering part toward the rotary member by the urging force of the urging member.

In the above cartridge, at least one of the covering member and the housing includes a support part that supports the rotary member and the detected member.

According to the above configuration, it is possible to reduce the number of components and to support the rotary member and the detected member by using at least one of the covering member and the housing.

In the above cartridge, the housing may include a filling port for filling the developer inside the housing, and a closing member that closes the filling port. The support part may be provided to the closing member.

According to the above configuration, it is possible to reduce the number of components and to support the rotary member and the detected member by using the closing member that closes the filling port.

The above cartridge may further include a transmission member configured to rotate by receiving the driving force from the driving receiving part, and including a transmitting part configured to transmit the driving force to the rotary member and an engaging part provided at a position different from the transmitting part and configured to move in accordance with the rotation of the transmission member. The rotary member may include a transmitted part configured to abut on the transmitting part and an engaged part configured to abut on the engaging part. The rotary member may be configured to move from a first position at which an abutting state between the transmitted part and the transmitting part is released to a second position at which the transmitted part abuts on the transmitting part due to the engaging part abutting on the engaged part.

According to the above configuration, it is possible to operate the cartridge with the rotary member being stopped after the driving force is input from the external device to the driving receiving part and until the engaging part of the transmission member abuts on the engaged part of the rotary member.

Thereafter, the engaging part of the transmission member abuts on the engaged part of the rotary member, so that it is possible to transmit the driving force from the transmission member to the rotary member.

Thereby, after the cartridge has operated stably, the driving force is transmitted from the transmission member to the rotary member, thereby moving the detected member.

As a result, it is possible to enable the external device to detect the detected member while the cartridge is stably operating.

In the above cartridge, the detected member may be configured to move in the axis direction while being restrained from rotating.

According to the above configuration, it is possible to move the detected member only in the axis direction.

For this reason, as compared to a configuration where the detected member is rotated, it is possible to save a moving trajectory space of the detected member.

According to the cartridge of the disclosure, it is possible to enable the external device to recognize that the unused cartridge has been mounted.

What is claimed is:

1. A cartridge comprising:

a housing configured to accommodate therein developer;

a driving receiving part configured to receive a driving force;

a rotary member configured to rotate by receiving a driving force from the driving receiving part and move in an axis direction, which is parallel with a rotational axis of the rotary member, while rotating; and a detected member configured to move in the axis direction by receiving a driving force from the rotary member, wherein the rotary member includes:

a main body part having a first surface facing the detected member in the axis direction and a second surface positioned at an opposite side of the first surface in the axis direction, an operating part arranged on the first surface and configured to apply a force for moving the detected member in the axis direction to the detected member, and an operated part arranged on the second surface and configured to receive a force for moving the main body part in the axis direction.

2. The cartridge according to claim 1, further comprising:

a developer carrier configured to carry thereon the developer.

3. The cartridge according to claim 1, wherein the operating part and the operated part are arranged at different positions in a diametrical direction orthogonal to the rotational axis.

4. The cartridge according to claim 1, wherein the detected member includes a first abutment part on which the operating part abuts, and wherein the housing includes a second abutment part on which the operated part abuts.

5. The cartridge according to claim 4, wherein at least one of the operating part and the first abutment part includes a first inclined part, which is inclined in a direction coming close to the first surface toward a downstream side in a rotating direction of the rotary member, and wherein at least one of the operated part and the second abutment part includes a second inclined part, which is inclined in a direction coming close to the second surface toward the downstream side in the rotating direction of the rotary member.

6. The cartridge according to claim 4, wherein the rotary member is configured such that, during the rotation of the rotary member, the operating part abuts on a portion of the first abutment part that is closest to the first surface and the operated part abuts on a portion of the second abutment part that is closest to the second surface at the same time.

7. The cartridge according to claim 1, further comprising:

a covering member including a covering part that faces the detected member from an opposite side of the rotary member in the axis direction.

8. The cartridge according to claim 7, further comprising:

an urging member abutting on the covering part and the detected member and configured to urge the detected member toward the rotary member.

9. The cartridge according to claim 7, wherein at least one of the covering member and the housing includes a support part that supports the rotary member and the detected member.

10. The cartridge according to claim 9, wherein the housing includes a filling port for filling the developer inside the housing, and a closing member that closes the filling port, and wherein the support part is provided to the closing member.

11. The cartridge according to claim 1, further comprising:

a transmission member configured to rotate by receiving the driving force from the driving receiving part, and including a transmitting part configured to transmit the driving force to the rotary member and an engaging part provided at a position different from the transmitting part and configured to move in accordance with the rotation of the transmission member, wherein the rotary member includes a transmitted part configured to abut on the transmitting part and an engaged part configured to abut on the engaging part, and wherein the rotary member is configured to move from a first position at which an abutting state between the transmitted part and the transmitting part is released to a second position at which the transmitted part abuts on the transmitting part due to the engaging part abutting on the engaged part.

12. The cartridge according to claim 1, wherein the detected member is configured to move in the axis direction while being restrained from rotating.

* * * * *